US012253319B2

(12) United States Patent
Geissele et al.

(10) Patent No.: US 12,253,319 B2
(45) Date of Patent: Mar. 18, 2025

(54) FIREARM EXTRACTOR

(71) Applicant: WHG PROPERTIES, LLC, North Wales, PA (US)

(72) Inventors: William H. Geissele, Lower Gwynedd, PA (US); Cory Morris, Drexel Hill, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 17/511,804

(22) Filed: Oct. 27, 2021

(65) Prior Publication Data

US 2022/0290937 A1 Sep. 15, 2022

Related U.S. Application Data

(63) Continuation-in-part of application No. 29/773,740, filed on Mar. 11, 2021, now Pat. No. Des. 1,020,964.

(51) Int. Cl.
*F41A 15/14* (2006.01)

(52) U.S. Cl.
CPC ..... *F41A 15/14* (2013.01)

(58) Field of Classification Search
CPC ..... F41A 15/12; F41A 15/14; F41A 15/16
See application file for complete search history.

(56) References Cited

U.S. PATENT DOCUMENTS 7,735,410 B2 6/2010 Clark
8,966,800 B1 * 3/2015 Olson ..... F41A 15/12 42/25
9,234,713 B1 * 1/2016 Olson ..... F41A 9/41
2008/0092733 A1 * 4/2008 Leitner-Wise ..... F41A 15/14 89/138
2011/0005383 A1 * 1/2011 Kramer ..... F24B 5/025 42/17
2012/0180354 A1 7/2012 Sullivan et al.
(Continued)

FOREIGN PATENT DOCUMENTS

CH 228000 A 7/1943

OTHER PUBLICATIONS

Adelmann. <https://www.shootingillustrated.com/content/ar-15-inspection-15-wear-failure-points-to-check/>. Sep. 8, 2018. (Year: 2018).*

(Continued)

*Primary Examiner* — Gabriel J. Klein
(74) *Attorney, Agent, or Firm* — Alston & Bird LLP

(57) ABSTRACT

Provided herein are extractors, bolt assemblies, firearms, and related methods, devices, and assemblies. A firearm extractor includes a first end, a second end opposite the first end, an axis defined between the first end and the second end, and a pivot portion between the first end and the second end. The extractor may include a notch defined at the inner side of the extractor at an axial location between the pivot portion and the first end that, in operation, engages a cartridge casing having a diameter greater than a casing of a 5.56 NATO cartridge or other platform-standard cartridge. A thickness of the extractor in at least one location defined at the axial location of the notch disposed radially inward of one or more lugs of a barrel or a barrel extension during cycling of the bolt may be greater than 0.019 inches.

23 Claims, 12 Drawing Sheets

(56) References Cited

U.S. PATENT DOCUMENTS

| | | | | |
|---|---|---|---|---|
| 2014/0076144 | A1* | 3/2014 | Gomez | F41A 5/18 42/25 |
| 2014/0090283 | A1 | 4/2014 | Gomez | |
| 2016/0047612 | A1* | 2/2016 | Sullivan | F41A 5/26 42/25 |
| 2018/0094889 | A1* | 4/2018 | Gomez | F41A 15/12 |

OTHER PUBLICATIONS

BRD. <https://brdgunworks.com/2021/02/08/ar-15-extraction-and-ejection-tips-and-tricks/>. Feb. 8, 2021. (Year: 2021).*

NLX. <https://web.archive.org/web/20200919095729/https://nextlevelarms.com/product/nlx-556-bolt/> Sep. 19, 2020. (Year: 2020).*

AR15.com. [Archived Thread]—6.8 Extractor the same as 5.56 ?. <https://www.ar15.com/forums/ar-15/6_8 Extractor_the_same_as_5_56_/121-332078/>. Jun. 14, 2007. (Year: 2007).*

RWA Range Warrior Accessories 2020 [online] retrieved from Internet Apr. 7, 2021] <URL: https://www.rangewarrioraccessories.com/product/extractor-for-ar15-7-62×39/> (3 pages).

Extractor Cartridge for Windham Weaponry 7.62 × 39mm, [online] retrieved from Internet Apr. 7, 2021 <URL: https://shop.windhamweaponry.com/product/8448512-762×39/> (7 pages).

Lone Star Armory, Tactical Springs 5-Coil Extra Power Extractor Spring [online] retrieved from Internet Feb. 9, 2021 <URL: https://www.lonestararmory.US/shop/firearm-components/semi-auto-components/ar-15-components/ar-15-upper-components/ar-15-bcg-parts/tactical-springs-5-coil-extra-power-extractor-spring/> (1 page).

SSK Firearms, Extractor, AR15, 7.62×39, Nickel Boron, [online] retrieved from the Internet Apr. 7, 2021 <URL: https://sskfirearms.lehighdefense.com/index.php?route=product/product&product_id=341> (4 pages).

LEXAR 15-223-Nibo-2048×2048 [online] retrieved from Internet Feb. 9, 2021 <URL: https://sskfirearms.lehighdefense.com/image/cache/catalog/LEXAR15-223-Nibo-2048×2048.jpg> (1 page).

BRA Black Rifle Arms, Small Arms Innovation, 6.5 Grendel, Extractor, Replacement Extractor [online] retrieved from Internet on Apr. 7, 2021 <URL: https://www.blackriflearms.com/-65-Grendel-Extractor-_p_297.html> (5 pages).

River's Bend Gun Co., Badger Ordnance M-16 style Extractor (part and labor) [online] retrieved from Internet Apr. 7, 2021 <URL: http://www.riversbendguncompany.com/products-and-services/badger-ordnance-m-16-style-cartridge-extractor> (2 pages).

River's Bend Gun Co., Badger Ordnance M-16 style Extractor [online] retrieved from Internet Apr. 26, 2021 <URL: https://images.squarespace-cdn.com/content/v1/54c55d5fe4b0688a8824d50a/1428955543167-ZFTJVOJJDFPON3GM305D/ke17ZwdGBToddI8pDm48kEdBr4U_FUuP4vm1AkpIPpVZw-zPPgdn4jUwVcJE1ZvWEtT5uBSRWt4vQZAgTJucoTqqXjS3CfNDSuuf31eOtV Hxeehk2D9gCIVwaTw-m9a8WSnF1MAtqOTQWkHE281RIh3z8U2ID8dOnsPxvoK4Fvw/306-90_91_92+badger+extractor.jpg> (1 page).

Extended European Search Report for EP Application No. 22203668.3 dated Mar. 13, 2023 (11 pages).

* cited by examiner

FIREARM EXTRACTOR

CROSS-REFERENCE TO RELATED APPLICATIONS

This application claims priority to and is a continuation-in-part of U.S. application Ser. No. 29/773,740, filed Mar. 11, 2021, which application is hereby incorporated by reference in its entirety.

TECHNOLOGICAL FIELD

Example embodiments relate generally to firearms, and, more particularly, to extractors for use in firearms that support and subsequently remove spent cartridge casings, and associated assemblies, components, and methods regarding the same.

BACKGROUND

Tactical rifles and other types of firearms may be equipped with a barrel and bolt that, in conjunction, hold or support a cartridge during operation of the firearm (e.g., with a chamber). A magazine contains the cartridges that are fed from the magazine to the chamber during operational cycles. Actuation of the operational cycle of the firearm may be performed manually by an operator (e.g., a bolt action rifles) or by way of an autoloading action (e.g., automatic or semi-automatic rifles), such as a high pressure propellant gas.

The firearm may integrate the barrel into a barrel assembly (e.g., with or without a barrel extension) which may include one or more lugs that engage corresponding lugs of the firearm's bolt. Following firing of the cartridge, an extractor attached to the bolt may operate to, via engagement with the cartridge casing, pull the casing from the chamber for further expulsion from the firearm by an ejector. Extractors are often subject to tight tolerances to ensure proper engagement with the cartridge size fired by the firearm while also subjected to increased forces due to their proximity to the firing operation. Through applied effort, ingenuity, and innovation, many of these identified problems have been solved by developing solutions that are included in embodiments of the present invention, many examples of which are described in detail herein.

BRIEF SUMMARY

The present disclosure relates generally to firearm extractors, assemblies and configurations that at least support, guide, position, extract, and/or expel a cartridge during a firearm's operational cycle.

According to some aspects of the present disclosure, a firearm extractor is provided that includes a first end and a second end opposite the first end where the first end and the second end define an axis extending therebetween. The extractor may include a pivot portion defined between the first end and the second end that is disposed at an inner side of the extractor and is configured to engage a bolt. The extractor may further include a notch defined at the inner side of the extractor at an axial location between the pivot portion and the first end. In operation, the notch may be configured to engage a cartridge casing having a diameter greater than a casing of a 5.56 NATO cartridge (e.g., a cartridge having a rim diameter greater than a 5.56 NATO or .223 Remington cartridge). A thickness of the extractor in at least one location defined at the axial location of the notch is greater than 0.019 inches where the at least one location may be configured to be disposed radially inward of one or more lugs of a barrel or a barrel extension during cycling of the bolt.

In some embodiments, the thickness at the at least one location may be greater than or equal to approximately 0.043 inches and less than or equal to approximately 0.055 inches.

In some embodiments, the thickness at the at least one location may be approximately 0.043 inches.

In some embodiments, the thickness at the at least one location may be approximately 0.055 inches.

In some embodiments, the thickness at the at least one location may be less than or equal to approximately 0.055 inches.

In some embodiments, thickness at the at least one location may be greater than 0.019 inches and less than or equal to approximately 0.055 inches.

In some embodiments, the thickness at the at least one location may be greater than or equal to approximately 0.043 inches.

In some embodiments, the extractor may further include support tower defined at an outer side of the extractor opposite the inner side at an axial location of the extractor between the pivot portion and the first end. In such an embodiment, the support tower may define a width in a circumferential direction perpendicular to the axis that is less than a width of the extractor, and the support tower may be positioned at a location other than the at least one location having the thickness that is greater than 0.019 inches.

In some further embodiments, the thickness of the extractor in all locations in a circumferential direction along a length of the notch, perpendicular to the axis, other than the location of the support tower is greater than 0.019 inches.

In some further embodiments, a height of an outer surface of the outer side of the extractor at the at least one location relative to the axis may be greater than a height of the outer surface of the outer side of the extractor elsewhere along a length of the extractor.

In some further embodiments, a height of an outer surface of the outer side of the extractor at the at least one location relative to the axis may be greater than the height of a standard 5.56 extractor.

In some further embodiments, the thickness of the extractor at the at least one location may be at least approximately 20% of a greatest thickness of the extractor at the support tower. In some embodiments, the thickness of the extractor between the inner surface of the notch and the at least one location (e.g., a location other than the support tower) may be at least approximately 5% greater than a traditional extractor of a given caliber cartridge.

In any embodiment, an outer surface of an outer side of the extractor opposite the inner side of the extractor may slope upwardly from a location closer to the second end to the least one location defined at the axial location of the notch that is greater than 0.019 inches.

In some embodiments, the notch of the extractor may extend axially along at least a portion of a length of the inner side of the extractor. The notch may include a first depth defined radially outward from a distal edge of the notch proximate the first end axially aligned with the at least one location and a second depth defined radially outwardly from a proximal edge of the notch axially aligned with the at least one location. The second depth may be greater than the first depth and the thickness is at the at least one location may be greater than the first depth.

In some embodiments, the thickness at the at least one location is the minimum thickness of the extractor at the axial location of the notch.

In some embodiments, the first end of the extractor body may further define a recess configured to prevent catching (e.g., snagging, fouling, malfunctioning, or other unintended contact) of a spent cartridge by the extractor during operation.

According to other aspects of the present disclosure, a bolt assembly is provided. An example bolt assembly may include bolt configured to engage one or more lugs of a barrel or a barrel extension during cycling of the bolt and may further define a groove. The bolt assembly may further include an extractor as described above that may be received by the groove of the bolt and pivotally attached with the bolt via the pivot portion of the extractor.

According to other aspects of the present disclosure, a firearm is provided. The firearm may include a barrel including an inner surface defining a bore configured to guide a projectile as the projectile is propelled through the bore by pressurized gas. The barrel may define a muzzle end and a chamber end opposite the muzzle end. The inner surface may define a chamber at the chamber end, wherein the chamber is configured to receive a cartridge and to support at least a portion of a cartridge casing during firing. The barrel may further define one or more locking lugs. In an instance in which the barrel further includes a barrel extension attached to the barrel, the barrel extension may define the one or more locking lugs. The firearm may further include a bolt defining one or more bolt lugs configured to engage the one or more locking lugs of the barrel and a groove. The firearm may further include an extractor as described above that is received by the groove of the bolt and pivotally attached with the bolt via the pivot portion of the extractor.

According to other aspects of the present disclosure a method of manufacturing at least a portion of an extractor is provided. The method may include providing a body that defines a first end and a second end opposite the first end, the first end and the second end defining an axis extending therebetween. The method may further include providing a pivot portion positioned between the first end and the second end, the pivot portion disposed at an inner side of the body of the extractor, wherein the pivot portion is configured to engage a bolt. The method may further include removing material from the body to define a notch at the inner side of the extractor at an axial location between the pivot portion and the first end, wherein, in operation, the notch is configured to engage a cartridge casing having a diameter greater than a casing of a 5.56 NATO cartridge (e.g., a cartridge having a rim diameter greater than a 5.56 NATO or .223 Remington cartridge). The method may further include removing material from an outer surface of the body opposite the inner surface to define a thickness of the extractor in at least one location defined at the axial location of the notch disposed radially inward of one or more lugs of a barrel or a barrel extension during cycling of the bolt, wherein the thickness is greater than 0.019 inches.

In some embodiments, removing material from the outer surface further defines a support tower extending from the outer surface of the extractor at an axial location of the extractor between the pivot portion and the first end. The support tower may define a width in a circumferential direction perpendicular to the axis that is less than a width of the extractor, and the support tower may be positioned at a location other than the at least one location.

In some embodiments, removing material from the body to define the notch at the inner side of the extractor may be such that the thickness of the extractor in all locations in a circumferential direction along a length of the notch, perpendicular to the axis, other than the location of the support tower is greater than 0.019 inches.

In some embodiments, removing of material from the outer surface of body may follow a path that slopes upwardly from a location closer to the second end to the least one location defined at the axial location of the notch that is greater than 0.019 inches.

In some embodiments, the method may further include removing material from the first end to define a recess configured to prevent catching of a spent cartridge by the extractor during operation.

A variety of additional aspects are also described in the following detailed description and in the attached claims. The aspects can relate to individual features and to combinations of features. It is to be understood that both the foregoing general description and the following detailed description are exemplary and explanatory only and are not restrictive of the broader inventive concepts upon which the example embodiments disclosed herein are based.

BRIEF DESCRIPTION OF THE DRAWINGS

Having thus described embodiments of the disclosure in general terms, reference will now be made to the accompanying drawings, which are not necessarily drawn to scale. The following drawings are illustrative of particular embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
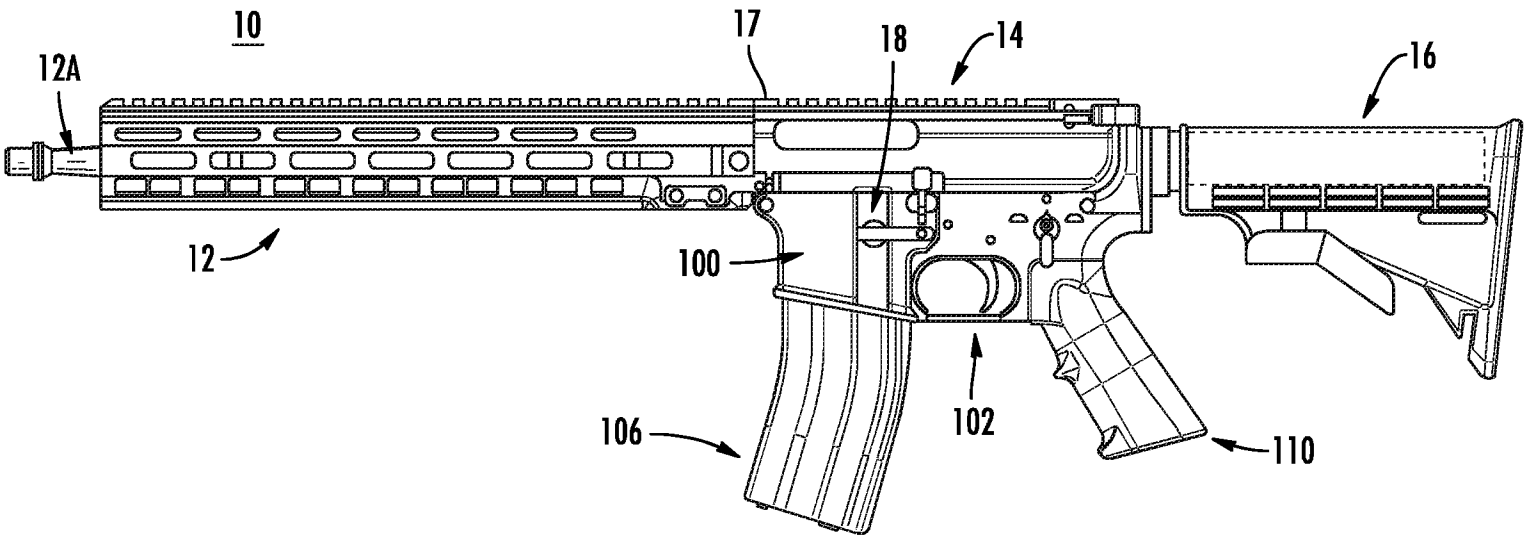
Figure 2:
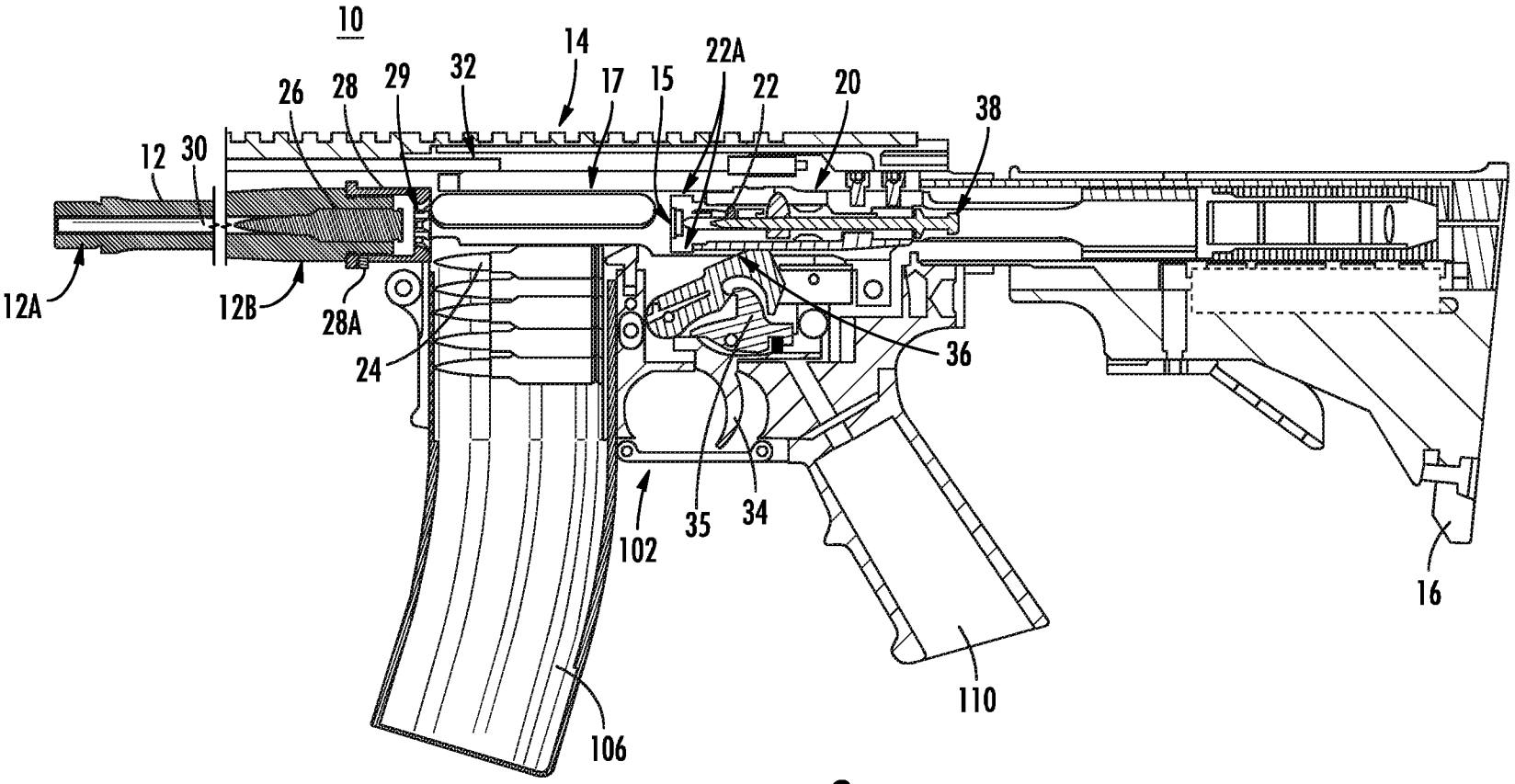
Figure 3:
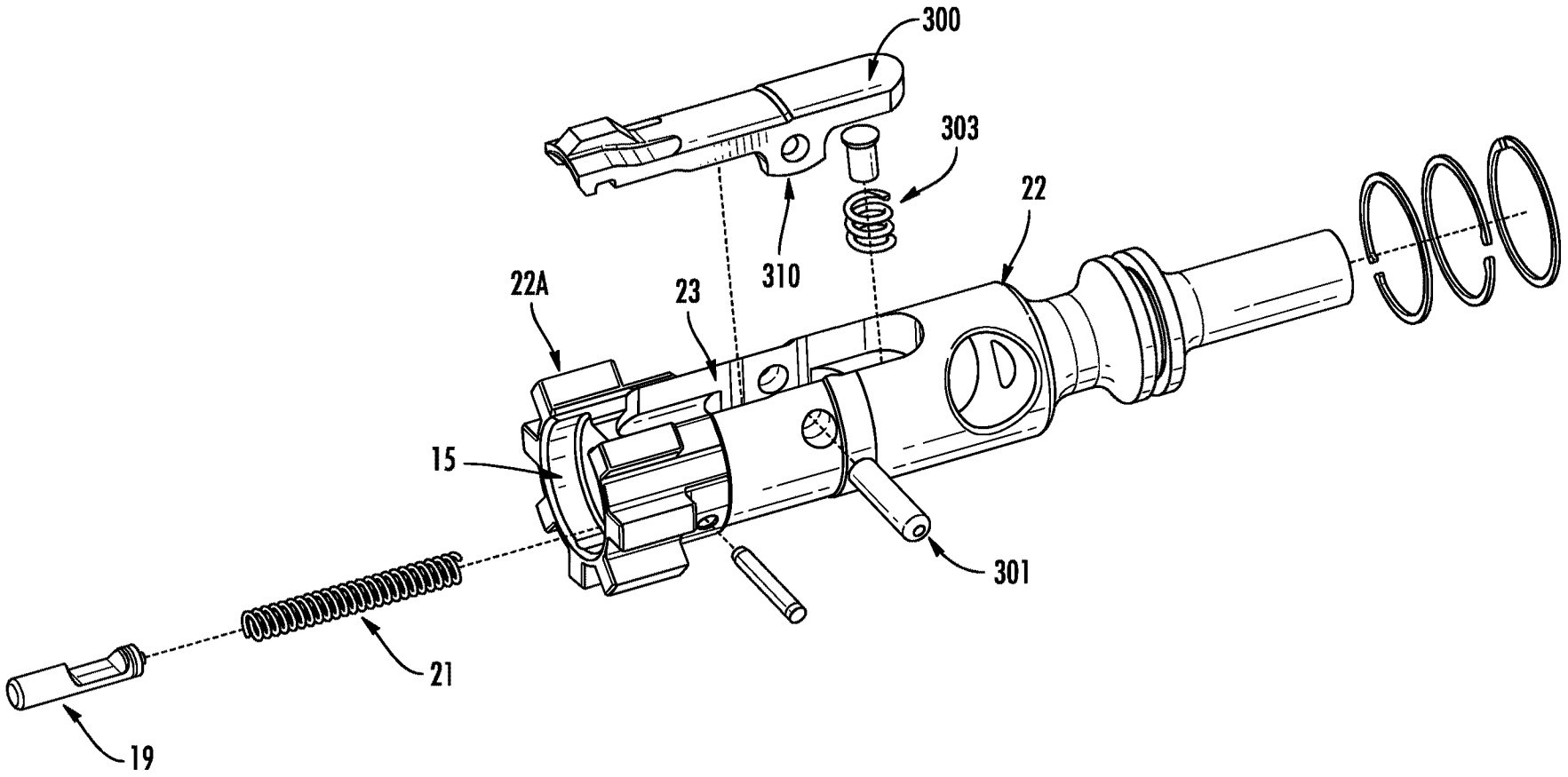
Figure 4A:
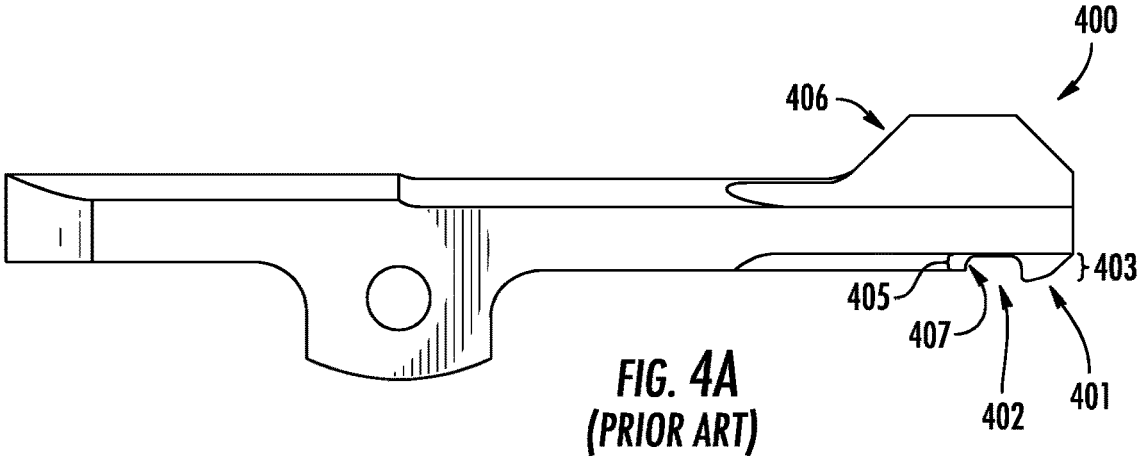
FIG. 4A (PRIOR ART)
Figure 4B:
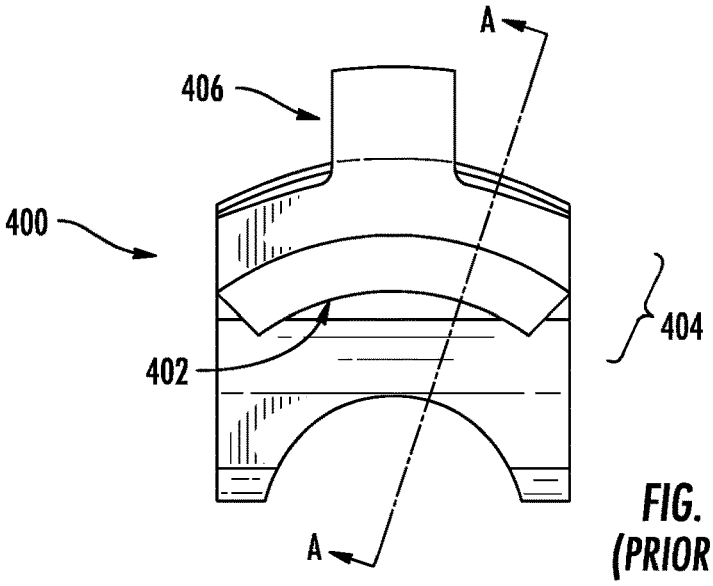
FIG. 4B (PRIOR ART)
Figure 4C:
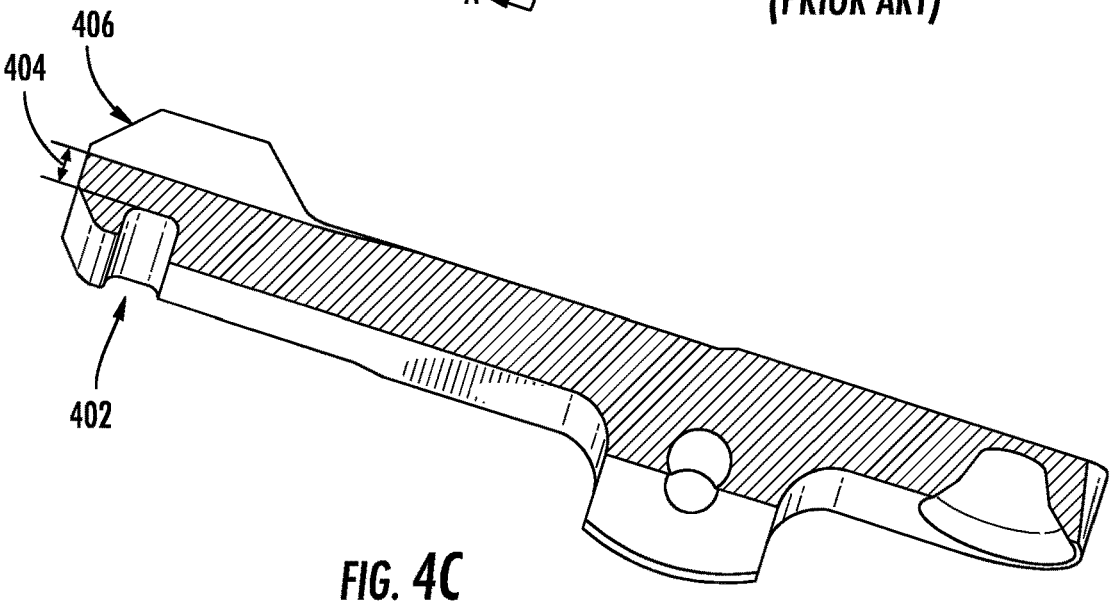
FIG. 4C (PRIOR ART)
Figure 5A:
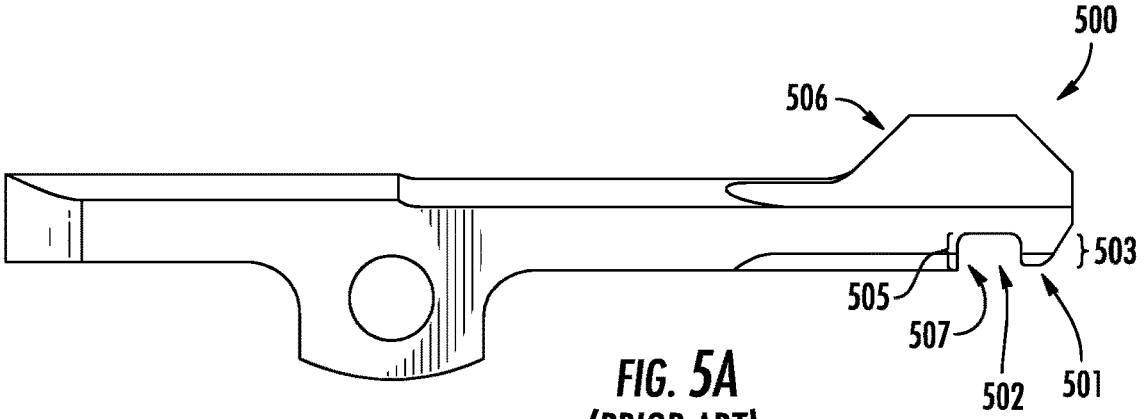
FIG. 5A (PRIOR ART)
Figure 5B:
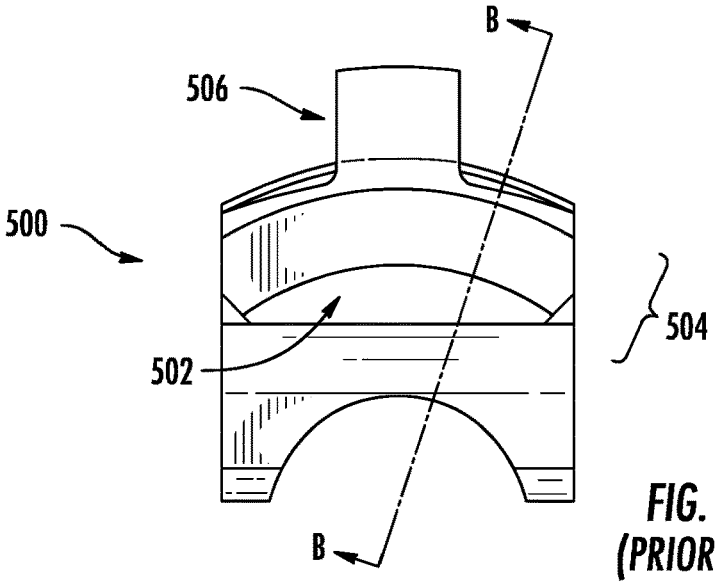
FIG. 5B (PRIOR ART)
Figure 5C:
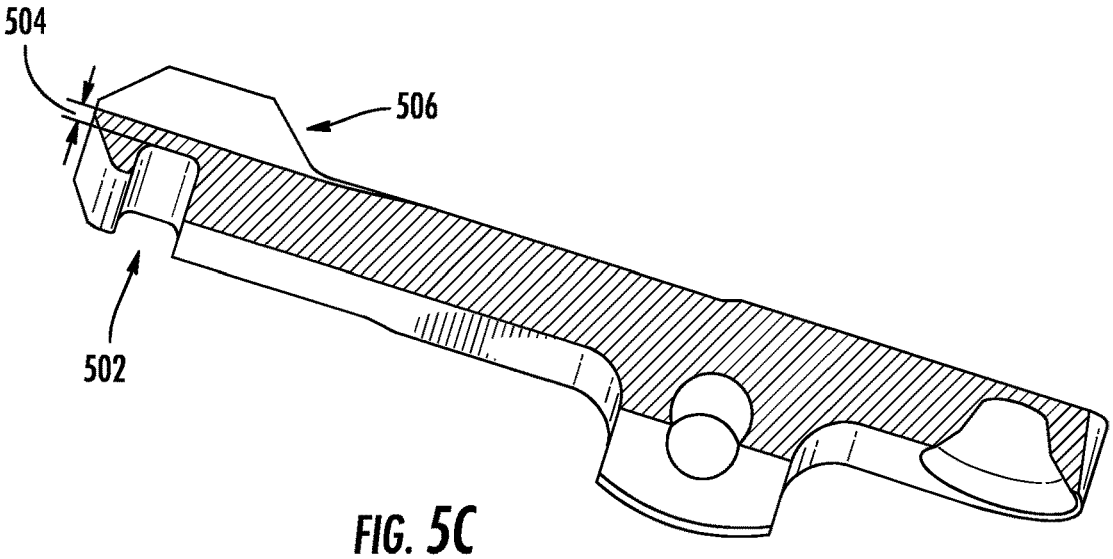
FIG. 5C (PRIOR ART)

FIG. 1 illustrates a side view of a firearm according to some example embodiments;

FIG. 2 illustrates a cross-sectional view of a portion of the firearm of FIG. 1 according to some example embodiments;

FIG. 3 illustrates a partially exploded view of a portion of an example bolt assembly according to some example embodiments;

FIGS. 4A-4C illustrate views of a prior art standard 5.56 mm extractor;

FIGS. 5A-5C illustrate views of a modified prior art extractor.

Figure 6:
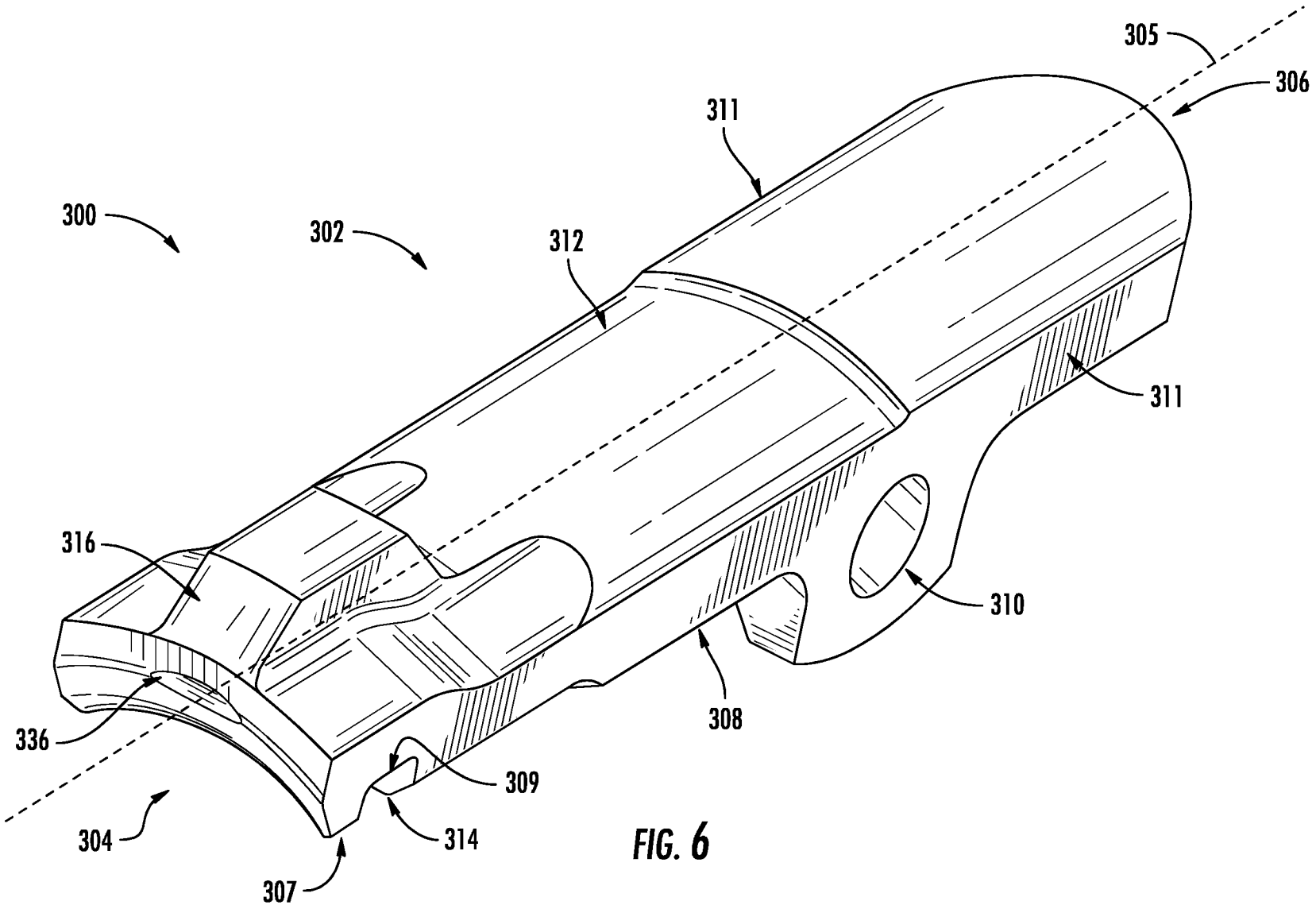
Figure 7:
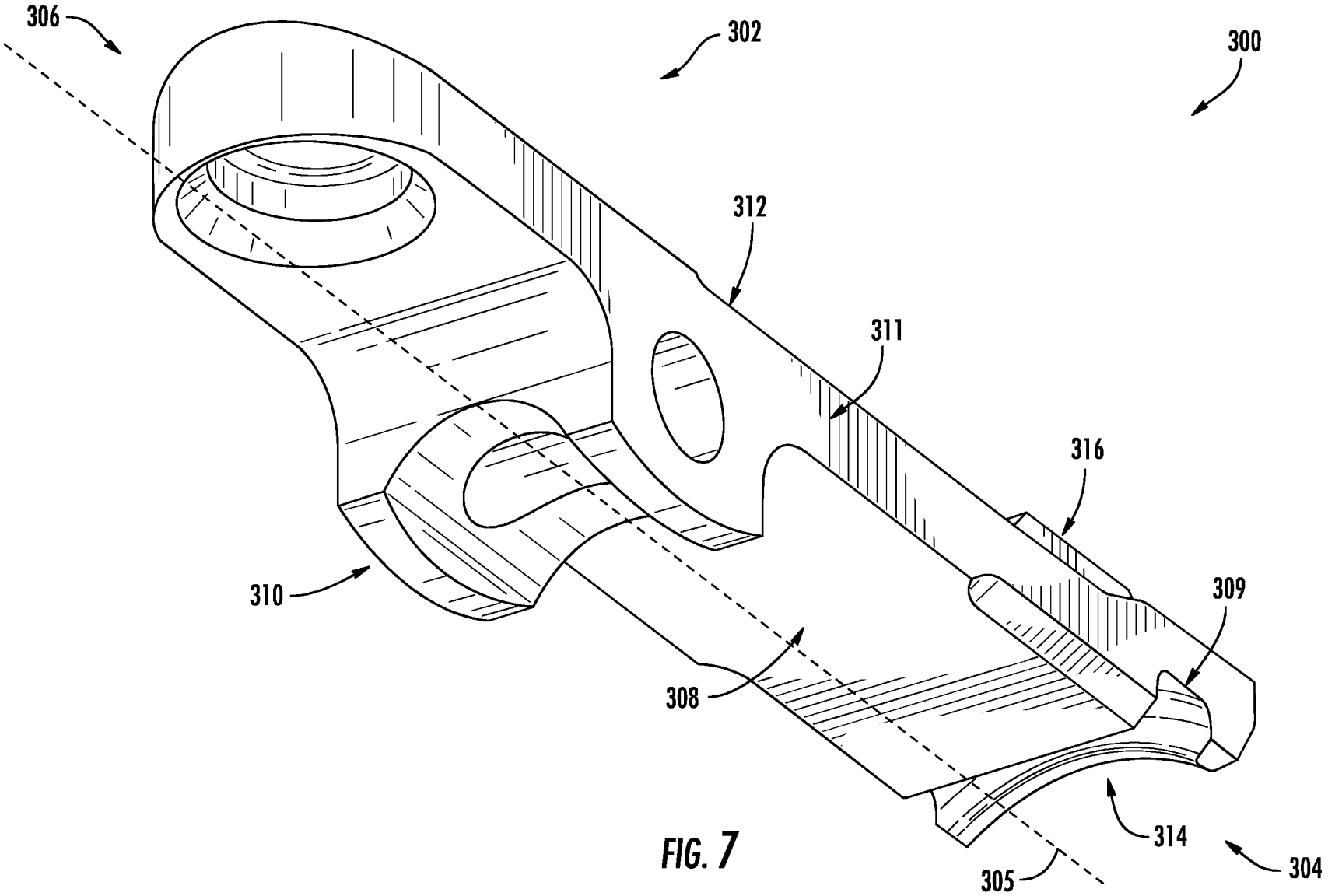
Figure 8:
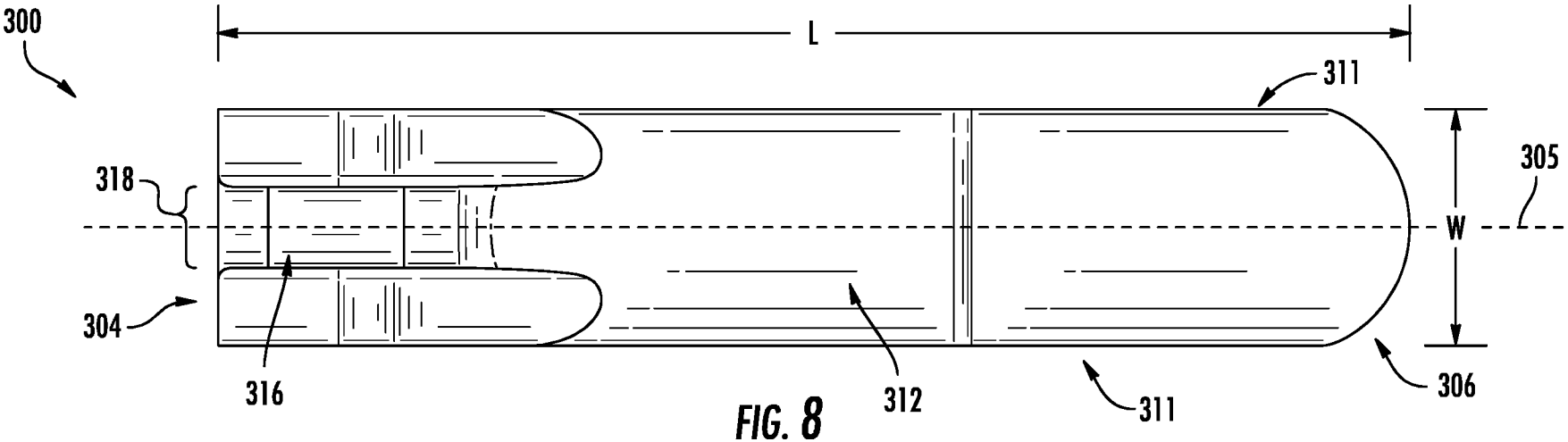
Figure 9:
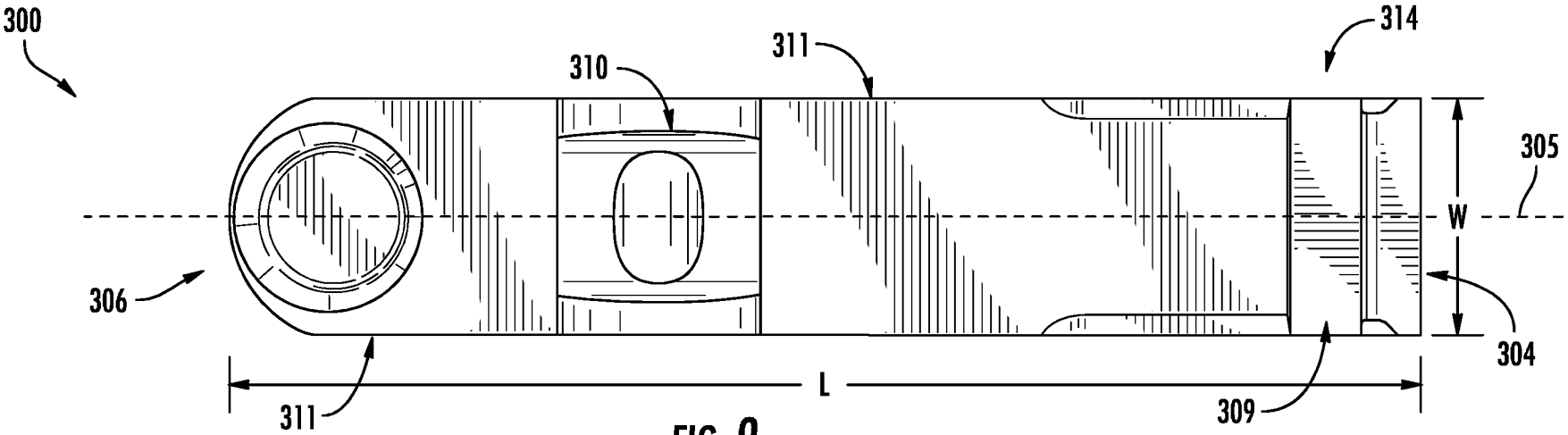
Figure 10:
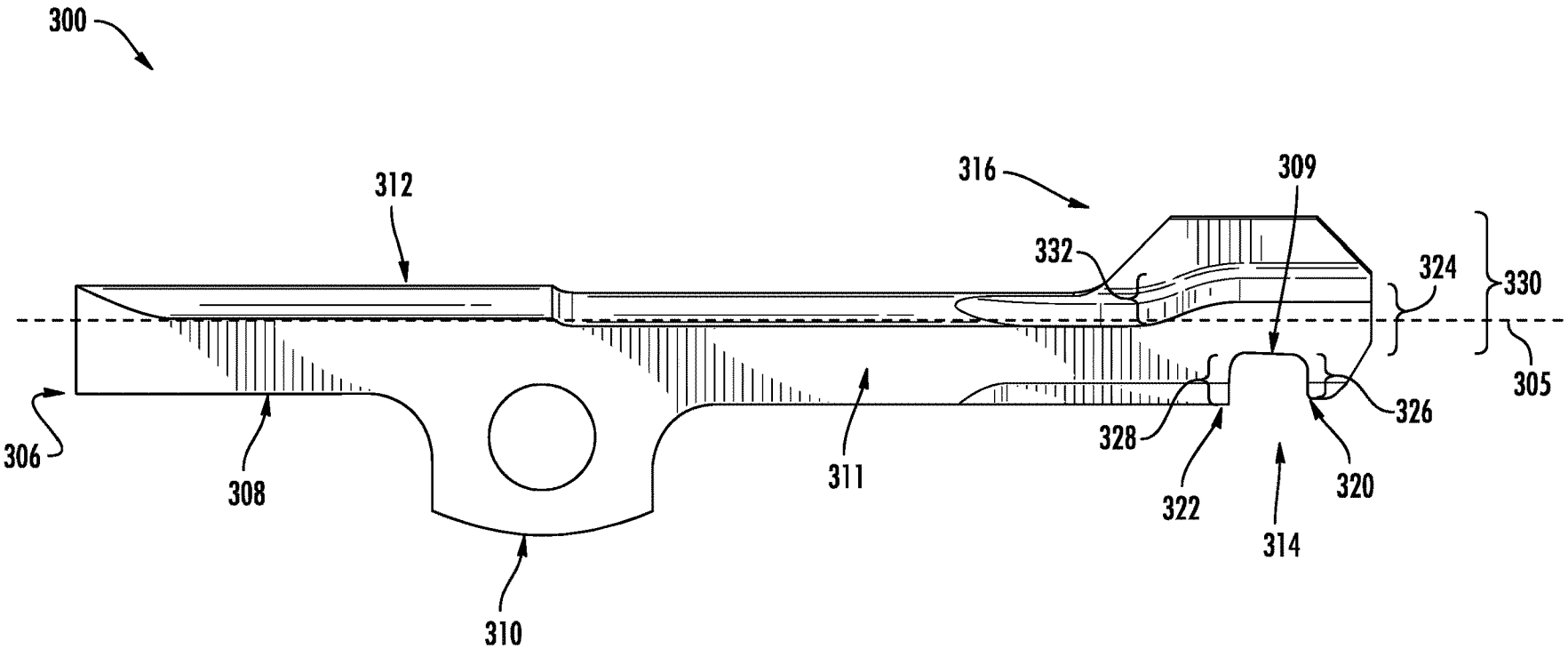
Figure 11:
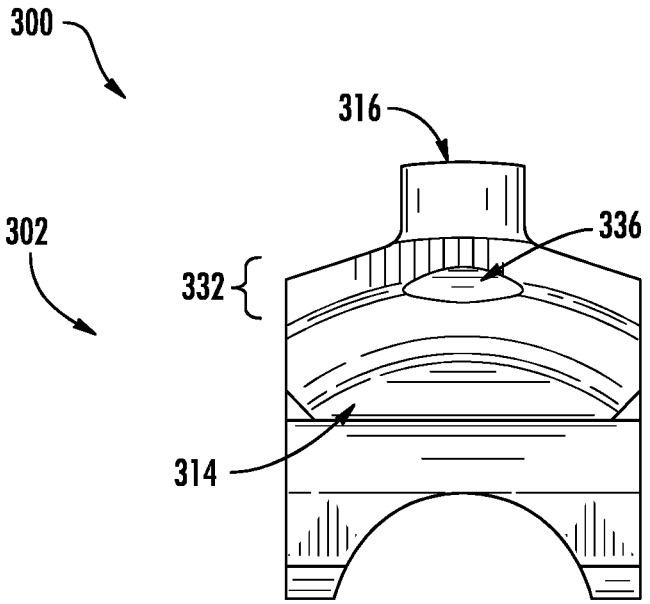
Figure 12:
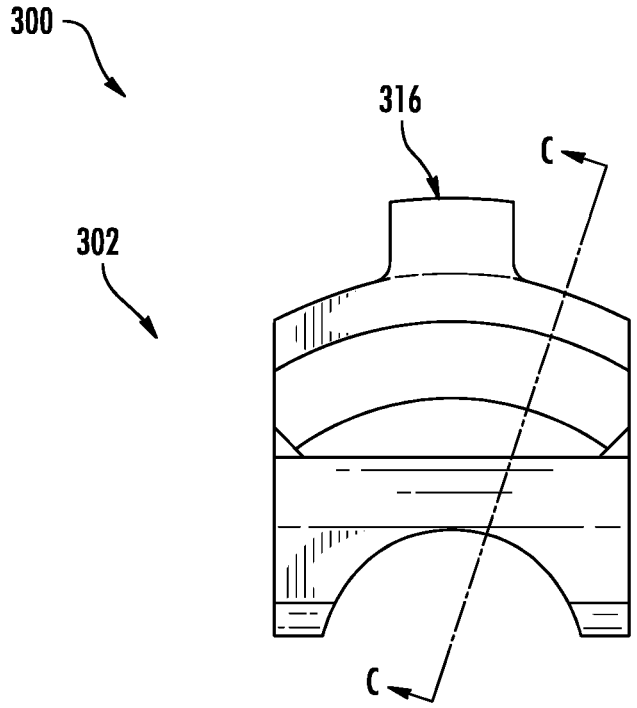
Figure 13:
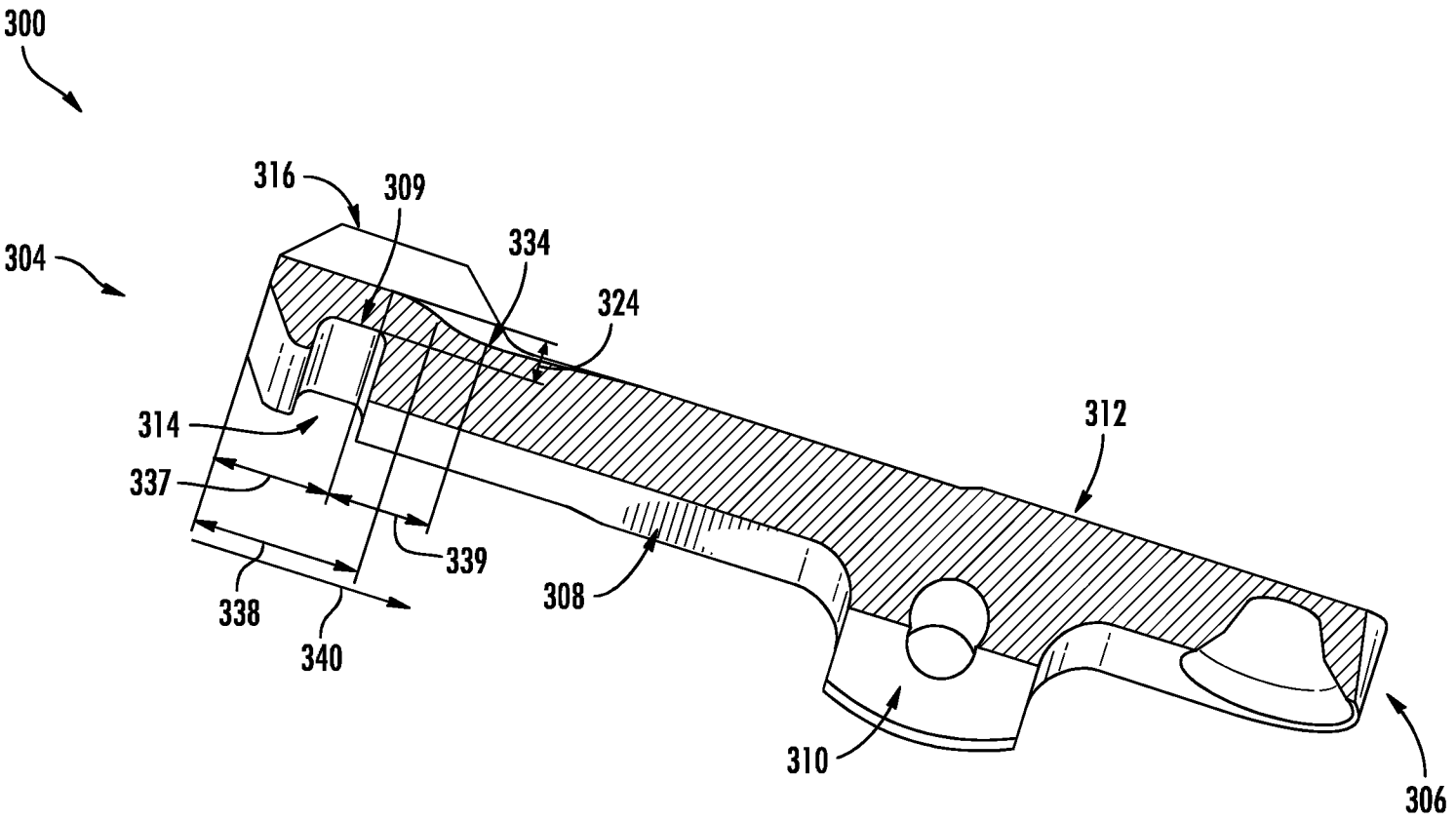
Figure 14:
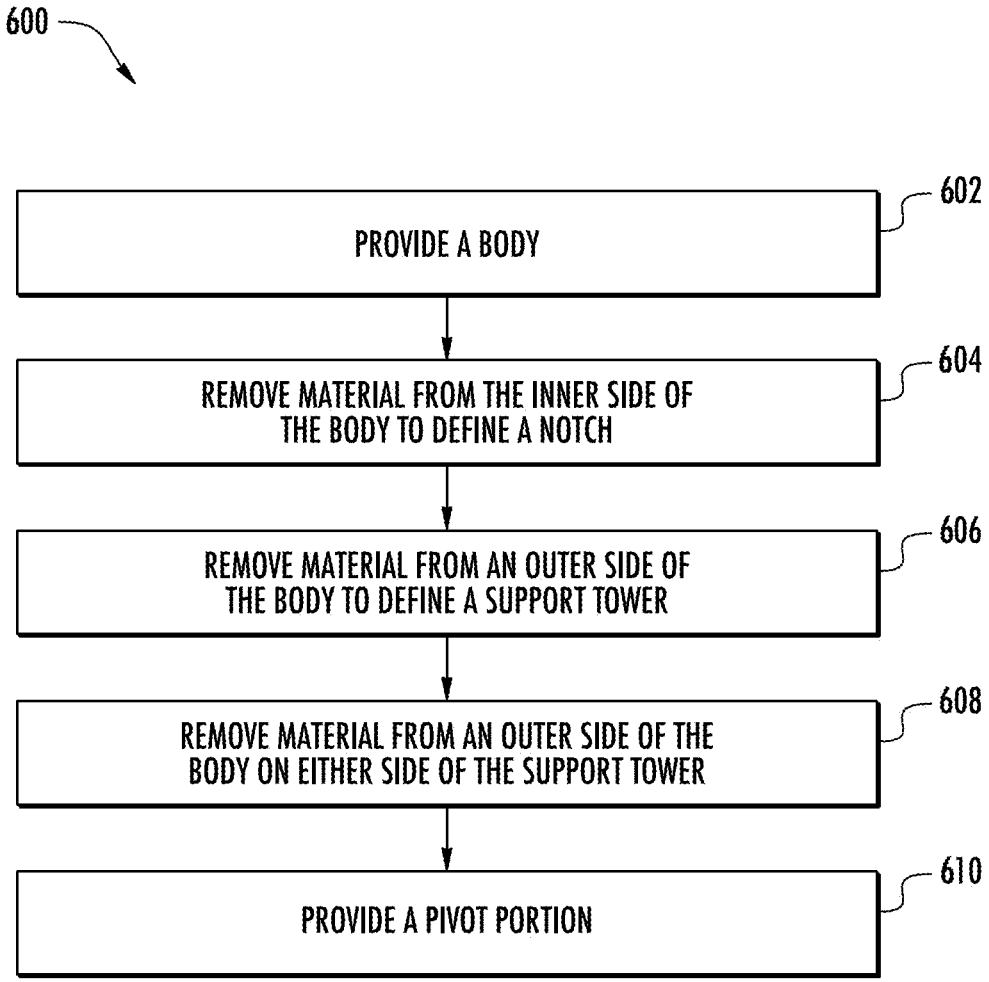

FIG. 6 illustrates a top isometric view of an example extractor of the present disclosure;

FIG. 7 illustrates a bottom isometric view of the example extractor of FIG. 6;

FIG. 8 illustrates a top view of the example extractor of FIG. 6;

FIG. 9 illustrates a bottom view of the example extractor of FIG. 6;

FIG. 10 illustrates a side view of the example extractor of FIG. 6;

FIG. 11 illustrates a front end view of the example extractor of FIG. 6 taken from the first end;

FIG. 12 illustrates a simplified front end view of an example extractor according to some example embodiments;

FIG. 13 illustrates a cross-sectional view of the example extractor of FIG. 12 taken along the line C-C in FIG. 12; and FIG. 14 illustrates an example method of manufacturing an extractor according to some example embodiments.

DETAILED DESCRIPTION

Overview

Some embodiments of the present invention will now be described more fully hereinafter with reference to the accompanying drawings, in which some, but not all, embodiments of the invention are shown. Like reference numerals refer to like elements throughout. Indeed, various embodiments of the invention may be embodied in many different forms and should not be construed as limited to the embodiments set forth herein. Rather, these embodiments are provided so that this disclosure will satisfy applicable legal requirements.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Thus, use of any such aforementioned terms, or similarly interchangeable terms, should not be taken to limit the spirit and scope of embodiments of the present invention.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

Firearms may employ extractors and ejectors, as part of a bolt assembly or otherwise, that operate to extract a spent cartridge casing following a firing operation and eject said cartridge casing from the firearm. As described hereafter, an extractor may be pivotally attached to the bolt of the firearm and define a notch that engages a rim of a cartridge casing when the bolt is positioned in a forward position. Following a firing action, a gas delivery system, other autoloading system, or manual operation may force the bolt rearward causing rotation of the bolt about its longitudinal axis and axial disconnection of the lugs of the bolt from the locking lugs of the barrel or barrel extension. During this movement, an ejector may apply a force to the cartridge parallel to and offset from the longitudinal axis of the bolt and cartridge to cause the spent cartridge casing to pivot about the notch in the extractor and eject from the firearm via an ejection port once the cartridge clears the lugs of the barrel or barrel extension. The ejector may be offset from the center of mass of the cartridge casing to cause the casing to rotate towards the firearm's ejection port. The extractor may further include an extractor spring configured to impart a force on the extractor body opposite the end of the extractor that engages the cartridge casing that, due to the pivotal engagement between the extractor and the bolt, urges the end of the extractor into engagement with the cartridge casing and further facilitates ejecting of the cartridge casing (e.g., once the spent cartridge casing has cleared the barrel or barrel extension as the bolt moves rearward).

The present disclosure relates to extractors for use with firearms, bolt assemblies, and related components, that may provide improved strength and support for the extractor during a firing operation while accommodating cartridges with increased dimensions. The extractor designs described herein may be configured to operate with emerging cartridge designs, calibers, etc. that are larger than standard 5.56 NATO cartridges while also providing increased durability and reliability not found in conventional systems.

Firearms of varying calibers and cartridge configurations may be manufactured using a common "platform" of components, some of which are common to all cartridges and some of which are modified on a cartridge-by-cartridge basis. For example, while originally manufactured for use with a .223 round, the AR-15 platform now includes weapons chambered for many different cartridges, including but not limited to, .223 Remington®, 5.56×45 mm NATO, FN 5.7×28 mm, 6.5 mm Grendel, 6 mm ARC, 6 mm Remington®, 6.8 mm Remington® SPC, 6.5 mm Creedmoor®, .224 Valkyrie, 7.62×39 mm, 7.62×51 NATO, 7.92×33 mm Kurz, 9×19 mm Parabellum, 10 mm SOCOM, .450 Bushmaster®, .458 SOCOM, .50 Beowulf®, etc. AR-15 rifles for each of these cartridges may be manufactured by adjusting at least the components that are dependent upon the cartridge shapes relative to the original 5.56×45 mm NATO sizing and configuration.

In some embodiments, a firearm platform designed for a particular cartridge (e.g., a 5.56 NATO cartridge) may be updated or modified to accommodate specifically larger cartridges, which may require a larger chamber and larger bolt carrier group components to accommodate the larger round. In such embodiments, the extractor may be modified or replaced, relative to the 5.56 mm extractor, with an extractor having a deeper notch (e.g., a notch that extends farther radially outward relative to the axial center of the bolt) to allow the larger cartridge to be accommodated by the bolt carrier group. Various embodiments of the present disclosure relate to a new extractor having a modified structure to accommodate a notch shape suited for such larger cartridges while also providing increased structural support and improved performance for the extractor relative to typical extractors for these larger rounds.

As described hereafter, the extractors of the present disclosure may be configured to engage a cartridge casing of a 6.5 mm Grendel, 6 mm ARC, 6 mm Remington®, 6.8 mm Remington® SPC, 6.5 mm Creedmoor, .224 Valkyrie, 7.62×39, 0.458 SOCOM, .50 Beowulf, .450 Bushmaster, and/or the like. Although described herein with reference to an extractor configured to engage certain cartridge casings in certain example configurations, the present disclosure contemplates that the extractor of the present disclosure may be configured for use with any cartridge casing, including 6 mm, 6.5 mm, 7 mm, 7.62 mm, 8 mm, 9.3 mm. 11.50 mm, and/or 12 mm cartridge casings, based upon the intended application of the extractor. In some embodiments, the present disclosure contemplates that the extractor embodiments described herein may be configured for use with any cartridge having a casing greater than a 5.56 NATO or .223 Remington cartridge (e.g., a cartridge having a rim diameter greater than a 5.56 NATO or .223 Remington cartridge), which may correspond to 0.378 inches at the rim of the casing and may also include manufacturing tolerances thereabout. For example, in some embodiments, the present disclosure contemplates that the extractor embodiments described herein may be configured for use with any cartridge having a rim diameter greater than approximately 0.378 in. In some embodiments, extractors according to the present disclosure may be dimensioned internally (e.g., via the depth, width, and/or radius curvature of the notch) according to the dimensions and tolerances specified by the Sporting Arms and Ammunition Manufacturer's Institute, NATO, or any other firearms standard setting body, such that the extractor is capable of use with any of the cartridges specified herein (e.g., cartridges larger than a 5.56 NATO or .223 Remington cartridge). In some embodiments, extractors according to the present disclosure may be dimensioned internally (e.g., at least via the depth, width, and/or radius curvature of the notch) in the same or substantially the same shape as their unimproved counterparts, and in such embodiments, material may be added at least to an exterior of the extractor relative to the unimproved counterparts.

The embodiments of the present disclosure, as described hereafter, may further operate to increase the strength, durability, reliability, etc. of the extractor by increasing the relative thickness (e.g., height of an upper surface) proximate a notch that engages the cartridge casing as compared to convention designs. Given the arcuate shape associate with extractors in the circumferential direction as described hereafter, the reference to a thickness herein may refer to a thickness measurement taken in a radial direction relative to the center of a cartridge casing received by the extractor (e.g., via the notch described herein) and/or a center of a bolt that aligns with the cartridge casing. Additionally or alternatively, the radial direction described herein may also be understood to be a direction perpendicular to the curved surface of the arcuate interior of a notch at each location along the notch, which may define a radius of curvature equivalent to the radius of the cartridge.

Firearm and Bolt Assembly

With reference to FIG. 1, a firearm 10 is shown in which the extractor embodiments of the present application may be implemented. As example firearm 10 may include a barrel 12, an upper receiver 14, a lower receiver assembly 100; a magazine 106, a grip 110, a trigger guard 102, an action, including a bolt carrier group (e.g., bolt, firing pin, ejector, etc.) (shown in FIGS. 2-3), an autoloading system (e.g., gas driven system (gas direct gas impingement, gas piston, etc.), recoil-driven autoloader, inertia-driven autoloader, etc.) (not shown), buttstock 16, magazine catch 18, ejection port 17, and/or other firearm components that would be appreciated in light of the present disclosure. In some embodiments, the firearm may be an AR-15 platform weapon configured to fire any of the cartridges disclosed herein or known in the art. In some embodiments, the firearm may be an AR-15 platform weapon configured to fire a cartridge having a casing with a greater diameter than the casing of a 5.56 NATO or .223 Remington round (e.g., a cartridge having a rim diameter greater than a 5.56 NATO or .223 Remington cartridge). Although described herein with examples referencing an AR-15 platform firearm, the present disclosure contemplates that the extractor embodiments and improvements described herein may be applicable to other large frame AR platforms (e.g., AR-10, LR-308, SR-25, and/or the like). In such large frame AR platforms, improvements to the extractor strength may likewise be made (e.g., for .308 Winchester, 7.62×51 NATO, 6.5 Creedmoor, .260 Remington, .338 Federal, .300 Winchester Magnum, or .243 Winchester cartridges).

With reference to FIG. 2, according to some embodiments, a magazine 106 may be held in a magazine well 112 defined by a lower receiver of the firearm. The magazines 106 and the magazine well 112 may include a clearance that may allow the magazine to drop free when released while also holding the magazine 106 in a stable position. This stable positioning may allow a cartridge 24 to be stripped from the top of the magazine 106 by a bolt 22 and fed forward and upward into the chamber 26 of the barrel 12 as the firearm cycles. The bolt 22 may then lock with a barrel extension 28 to hold the cartridge 24 in place. The bolt lugs 22A interface with the locking lugs 29 of barrel extension 28 to lock the bolt 22, for example, by inserting the bolt lugs 22A between the barrel extension locking lugs 29 and rotating the bolt 22 about its longitudinal axis to align the rear of the bolt lugs 22A with the inner, forward surface of the barrel extension locking lugs 29. The locking lugs 29 of the barrel extension 28 (or as defined by the barrel 12 in other embodiments) may define an associated clearance as the distance between the innermost surface of the locking lugs 29 to the center axis of the bolt 22 and/or barrel extension 28. This clearance may at least partially constrain one or more dimensions of the extractor of the present disclosure (e.g., extractor 300 in FIG. 6) in that the lug-bearing portion of the bolt must at least fit past these lugs during operation. For example, the thickness at the least one location described hereafter is configured to be disposed radially inward of one or more lugs of a barrel or a barrel extension during cycling of the bolt to pass radially inward of the lugs. The support towers detailed herein may likewise pass between adjacent lugs. The inner surface 30 of the barrel 12 at the chamber 26 may support the cartridge casing during ignition of the cartridge propellent, preventing the cartridge casing from deforming, splitting, or otherwise misfiring during the increase in internal pressure and facilitating direction of the expanding gases behind the bullet to propel the bullet down the bore of the barrel.

Although described herein with reference to a barrel 12 that engages a barrel extension 28, the present disclosure contemplates that, in some embodiments, the barrel 12 may instead include locking lugs 29 (e.g., without a barrel extension 28). In such an embodiment, the bolt lugs 22A may interface with the locking lugs 29 defined by the barrel 12 to lock the bolt 22. Similar to the barrel extension 28, this locking action may occur by inserting the bolt lugs 22A between the locking lugs 29 of the barrel 12 and rotating the bolt 22 to align the rear of the bolt lugs 22A with the inner, forward surface of the locking lugs 29 of the barrel 12. Said differently, the extractor embodiments described herein may be applicable for use with firearms that include a barrel and associated barrel extension as well as firearms that rely upon a barrel alone (e.g., without a barrel extension), such as an M14.

With continued reference to FIG. 2, a cross-section of a portion of the firearm 10 is shown. In various embodiments, the barrel 12 includes a muzzle end 12A and a chamber end 12B that may attach to a barrel extension 28 attached to the upper receiver 14. The barrel extension 28 and the chamber end 12B of the barrel 12 may be connected via barrel interface surfaces 28B (e.g., threading or the like). In some embodiments, the outer surface of the barrel 12 and inner surface of the barrel extension 28 may have complementary surfaces, such as threading, for engaging the components. The barrel 12 and barrel extension 28 may be held together by a fastener 28A (e.g., a set screw or the like.).

The depicted firearm 10 is further shown with a bolt carrier group 20 and a bolt 22 (e.g., described further with reference to FIG. 3) configured to strip a cartridge 24 from the magazine 106 and feed the cartridge into the chamber 26 of the chamber end 12B of the barrel 12 for firing. The cartridge 24 may be retained in the chamber 26 by a taper in the inner surface 30 of the barrel 12 at the front end and by the bolt 22 at the rear end (e.g., via engagement between the cartridge 24 and a corresponding recess 15 defined by the bolt), with the chamber 26 providing support for the casing. Firing of cartridge 24 occurs during actuation of trigger 34 while the bolt carrier group 20 is in the forward position (e.g., toward the left of FIG. 2), and the bolt lugs 22A are engaged with the barrel extension lugs 29. Actuation of trigger 34 causes disconnector 35 to release hammer 36. The firing pin 38 is driven toward the primer of cartridge 24 when the firing pin 38 is struck by hammer 36, thus firing the chambered cartridge 24. Gas delivery system 32 directs at least some of the expanding gases generated by firing the chambered cartridge 24 from a location at or near the muzzle end to at least force the bolt carrier group 20 rearward (e.g., toward the right of FIG. 2) causing disconnection of the lugs, extraction of the spent cartridge casing from chamber 26, ejection of the spent cartridge from the chamber 26 via the ejection port 17, and resetting the trigger assembly components (e.g., hammer 26, disconnector 35, trigger 34, and other trigger components known in the art). Although illustrated and described herein with reference to a gas delivery system configured to extract (e.g., alongside extractor 300 described hereafter) the spent cartridge casing and reset the trigger assembly components, the present disclosure contemplates that the extractor embodiments described herein may be applicable to manual firearm operational cycles (e.g., performed by an operator), such as those found in bolt action firearms.

With reference to FIG. 3, an exploded view of a bolt assembly including the bolt 22 and extractor 300 is illustrated. As shown, the bolt 22 may define bolt lugs 22A as described above that interface with the locking lugs 29 of barrel extension 28 (shown in FIG. 2) to lock the bolt 22. The bolt 22 may also define a groove 23 (e.g., slot, channel, recess, etc.) configured to receive the extractor 300 therein. In order to pivotally attach the extractor 300 to the bolt 22, the bolt 22 may employ an extractor pin 301 that engages with a pivot portion 310 of the extractor 300 as illustrated in FIGS. 6-13. This pivotal engagement between the extractor 300 and the bolt 22 via the extractor pin 301 may operate to allow the extractor 300 to pivot about the pivot portion of the extractor 300 such that the extractor 300 may engage/disengage and guide a cartridge casing as described above. For example, the extractor 300 may define a notch, as illustrated in FIGS. 6-13, that is dimensioned to engage a cartridge casing within the chamber of the firearm (e.g., engage a rim of the cartridge casing) when the bolt carrier group 20, including the bolt 22, is in the forward position. Following a firing action by the firearm 10, a gas delivery system 32 (or manual operation) may force the bolt carrier group 20 rearward causing rotation of the bolt 22 and disconnection of the lugs 22A from the locking lugs 29. During this movement, an ejector 19 may input axial force (e.g., as urged by ejector spring 21) to the cartridge to cause the spent cartridge casing to pivot about the notch in the extractor 300 and eject from the firearm 10. The ejector 19 may be offset from the center of mass of the cartridge casing to cause the casing to rotate towards the firearm ejection port (e.g., ejection port 17 in FIGS. 1-2). The extractor 300 may further include an extractor spring 303 configured to impart a force on the extractor body 300 opposite the end of the extractor that engages the cartridge casing (e.g., a second end as described hereafter). Such a force may, due to the pivotal engagement between the extractor 300 and the bolt 22, urge the first end of the extractor 300 into engagement (e.g., radially inward) with the cartridge casing when the bolt 22 is in the forward position and facilitate hooking and ejecting the cartridge casing as the bolt 22 moves to a rearward position (e.g., once the spent cartridge casing has cleared the barrel or barrel extension).

With reference to FIGS. 4A-4C, a prior art extractor 400 for use with a standard 5.56 NATO cartridge is illustrated. As shown, the extractor 400 may define a notch 402 configured to engage a cartridge casing associated with a 5.56 NATO round via a hook portion 401. Said differently, the notch 402 may be dimensioned (e.g., sized and shaped) so as to engage a rim of a 5.56 mm cartridge casing, such that the notch defines a complementary shape to a portion of the outer rim of the cartridge casing. The hook portion 401 may, in an instance in which the rim of the cartridge casing is at least partially disposed within the notch 402, impinge upon the rim of the cartridge casing so as to cause extraction (e.g., movement from the forward position) of the spent cartridge casing following a firing action. As such, the depth (e.g., depths 403 and 405) associated with the notch 402 (e.g., radially measured inward distances associated with the notch) may be dimensioned (e.g., sized and shaped) to engage a complementary dimension of a standard 5.56 NATO cartridge casing. The "depth" of the notch 402 may, as shown in FIG. 4A, refer to a first depth 403 measured from the radially outward most portion of the notch 402 to the center of the bolt 22 when in receipt of a cartridge. The second depth 405 may be measured from a flat, rearward side 407 of the notch 402 along a center axis (e.g., similar to axis 305 in FIG. 6) of the extractor 400.

As would be evident to one of ordinary skill in the art in light of the present disclosure, the 5.56 NATO cartridge casing may also refer to a .223 Remington round in that the notch 402 of the standard 5.56 mm extractor 400 may be configured to also engage a cartridge casing of a .223 Remington cartridge due to the substantially identical (e.g., dimensionally similar) cartridge casing size (e.g., often within 0.001 inch) between these cartridges. The extractor 400 may include a web thickness 404 of approximately 0.042 inches as shown in FIG. 4C (e.g., a radially measured thickness of the extractor 400 along the axis A-A shown in FIG. 4B which intersects the center axis of the cartridge and bolt) that does not include any thickness associated with the support tower 406 extending from the extractor 400. With reference to FIG. 4B, the outer surface of the extractor may not necessarily be flat in the circumferential direction. In some embodiments, the webbing thickness may be a smallest thickness from the outer side to the notch in the radial direction excluding areas that are chamfered or otherwise cut along the sides for clearance purposes.

The depth of the notch 402 of the standard 5.56 NATO extractor 400 illustrated in FIGS. 4A-4C may not be dimensioned to operate with larger cartridge casings. In order to accommodate the dimensions associated with these larger cartridge casings, the dimensions of the extractor (e.g., depth of the notch) may be similarly modified as shown in a prior art extractor 500 of FIGS. 5A-5C. As shown, the extractor 500 may similarly define a notch 502 and hook portion 501, but such a notch 502 may be configured to engage a cartridge casing associated with a 6 mm ARC, a 6.5 mm Grendel, or other cartridge casing having a diameter that is greater than a 5.56 NATO round and/or greater than a .223 Remington round (e.g., a cartridge having a rim diameter greater than a 5.56 NATO or .223 Remington cartridge). The notch 502 may be dimensioned (e.g., sized and shaped) so as to engage a rim of a 6 mm ARC or 6.5 mm Grendel cartridge casing. The hook portion 501 may, as above, impinge upon the rim of the cartridge casing so as to cause extraction (e.g., movement from the forward position) of the spent cartridge casing following a firing action. As such, the depth (e.g., depths 503 and 505) associated with the notch 502 (e.g., radially measured inward distances associated with the notch) may be dimensioned (e.g., sized and shaped) to engage a complementary dimension of a 6 mm ARC or 6.5 mm Grendel cartridge casing. Similar to extractor 400, the "depth" of the notch 502 may, as shown in FIG. 5A, refer to a first depth 503 measured from the radially outward most portion of the notch 502 to the center of the bolt 22 when in receipt of a cartridge. The second depth 505 may be measured from a flat, rearward side 507 of the notch 502 along a center axis (e.g., similar to axis 305 in FIG. 6) of the extractor 500. This increase in the depth of the notch 502, however, results in a reduction of the web thickness 504 of the extractor 500. As above, the web thickness may refer to a radially measured thickness of the extractor 500 as shown in FIG. 5C taken along the axis B-B shown in FIG. 5B that does not include any thickness associated with the support tower 506 extending from the extractor 500.

As shown, these prior art attempts to modify a standard 5.56 mm extractor 400 as shown in FIGS. 4A-4C to accommodate a larger cartridge casing, such as a 6 mm ARC or 6.5 mm Grendel cartridge casing, results in a reduced web thickness of the extractor 500. In the example extractor 500 of FIGS. 5A-5C, the web thickness is reduced to 0.019 inches. This reduction may occur because the extractor 500 of FIGS. 5A-5C may be created by modifying the platform standard extractor 400 of FIGS. 4A-4C by cutting the notch deeper. Said differently, the difference between the extractor 500 of FIGS. 5A-5C and the extractor 400 of FIGS. 4A-4C may be solely a subtraction of material from the extractor 400 of FIGS. 4A-4C. The inventors have discovered that this reduction in thickness may operate to reduce the relative strength of the extractor 500. Due to the forces subjected to the extractor during a firing operation, this reduction in strength, the inventors have discovered that failure of the extractor may occur, either via causing malfunctions and misfires or by permanent breakage of the extractor. As such, the embodiments of the present disclosure are configured to address these issues and others by providing an extractor that may engage a larger cartridge casing, such as a 6 mm ARC or 6.5 mm Grendel cartridge (e.g., a caliber of at least .223 inches or greater than 5.56 mm), while providing an increased thickness (e.g., greater than 0.019 inch) at the notch.

Extractor

Embodiments of the present disclosure include new extractor manufactured specifically for larger cartridges than the standard 5.56 NATO or .223 Remington rounds, or equivalent standard rounds of other firearm platforms. With reference to FIGS. 6-13, an embodiment of an extractor 300 of the present disclosure is illustrated. As shown, the extractor 300 may define a body 302 that may be, in some embodiments, a single, integral body (e.g., formed from a single piece of material). In other embodiments, the body 302 may be formed as an assembly or collection of distinct elements or parts. In any embodiment, the extractor 300 may define a first end 304, a second end 306 opposite the first end 304, and an axis 305 extending therebetween. As described above, the first end 304 may be configured to engage a cartridge casing within the chamber (e.g., a distal end of the extractor 300 when installed in a firearm 10). The extractor 300 (e.g., the body 302 of the extractor 300) may further define an inner side 308 of the extractor configured to face towards the bolt, an outer side 312 of the extractor 300 opposite the inner side 308 and configured to face outwardly towards the ejection port of the firearm, and two lateral sides 311 extending therebetween. As shown, in some embodiments, the lateral sides 311 may be substantially parallel with respect to one another. The inner side of the extractor 300 may define a pivot portion 310 (e.g., one or more openings defining a pivot axis of the extractor and through which the pivot pin of the bolt carrier group may extend to attach the extractor to the bolt) between the first end 304 and the second end 306. As described above, the pivot portion 310 may be configured to pivotally engage the extractor 300 with the bolt 22 (e.g., so as to form at least a portion of the bolt assembly). The inner side 308 of the extractor may further be dimensioned (e.g., along with the dimensions for the extractor body 302) such that the extractor 300 may be received by a corresponding groove (e.g., groove 23 in FIG. 3) of the bolt 22.

The extractor may further include a notch 314 defined at the inner side 308 of the extractor. The notch 314 may be positioned at an axial location between the pivot portion 310 and the first end 304 (e.g., along the length L of the body 302 and proximate the first end 304) and may be, as described above, configured to engage a cartridge casing of a bullet when in operation. For example, the extractor 300 may define a hook portion 307 that is configured to hook or otherwise impinge on the rim of the cartridge casing. In some embodiments, the extractor may include a recess 336 at the first end 304 (e.g., on a surface of the first end extended between the lateral sides 311) to allow the extractor to avoid catching during operation. Said differently, the recess 336 may define an indentation, scallop, or the like, configured to reduce contact between a cartridge casing and the extractor 300 as the spent cartridge is pivoted about the notch in the extractor 300 by the force applied to the spent cartridge by the ejector (e.g., ejector 19 in FIG. 3). The recess 336 may improve reliability of the extractor by preventing the cartridge from becoming stuck to the extractor during cycling. As illustrated in, for example, FIGS. 6, 7, and 11, the notch 314 of the extractor 300 is arcuate or curved in the circumferential direction (e.g., relative the axis 305) so as to engage a complimentary curved rim of a cartridge casing. As such, a depth of the notch may refer to the radial measurement of the notch from the inner side 308 with the radial measurements taken along a radial axis defined relative to a center of the cartridge when engaged with the bolt or a center of the bolt. As shown in FIG. 10, in some embodiments the notch may extend axially (e.g., along axis 305) at least a portion of the length L of the extractor and may define a distal edge 320 and a proximal edge 322.

A first depth 326 of the notch may be defined radially outward from a distal edge 320 of the notch 314 proximate the first end, and a second depth 328 may be defined radially outwardly from the proximal edge 322 of the notch 314. In some embodiments, the second depth 328 may be greater than the first depth 326 such that the leading edge of the notch 314 (e.g., the distal edge 320) is shorter in the radial direction along a center axis of the extractor (relative to the width direction) than the trailing edge of the notch 322 (e.g., the proximal edge 322). In some embodiments, the inner side 308 of the extractor 300 may be at least partially flat in the direction extending between the notch 314 and the pivot portion 310 such that the depth of the notch varies along its width. In some embodiments, the distal edge 320 may be curved in the same manner as the notch 314. In some embodiments, a third depth of the notch may be defined by the distance from the center of the bolt and/or cartridge to the inner surface 309 of the notch 314. The radial direction herein may also be understood to be a direction perpendicular to the curved surface of the arcuate interior of the notch 314, which may define a radius of curvature equivalent to the radius of the cartridge or bolt. The resting position of the extractor 300 may change due at least in part due to a cartridge received by the bolt 22. In other words, the extractor 300 may rotate radially outwards from the axis 305 in an instance in which a cartridge is received by the bolt 22 so as to apply pressure (e.g., a radially inward force) to the cartridge. In some embodiments, an internal radius from the inner surface of the notch 314 to the center of the bolt and/or cartridge may be based on this resting position against the cartridge.

The notch 314 may further be configured to engage a cartridge casing of a round having a casing larger than a 5.56 NATO round and/or a .223 Remington round. The notch 314 may be configured for use with a, for example, 6 mm ARC or 6.5 mm Grendel cartridge casing and, as such, may be dimensioned such that the notch 314 engages a rim of these cartridges. In some embodiments, the axis 305 of the extractor is parallel with the axis of the bolt when the notch is engaged with the cartridge. As such, the depth of the notch 314 (e.g., the radially measured recess of the notch 314 from the inner side 308 at the center of the extractor) may be dimensioned (e.g., sized and shaped) to interface with a cartridge casing having a greater diameter than the casing of a 5.56 NATO round and/or a .223 Remington round (e.g., a cartridge having a rim diameter greater than a 5.56 NATO or .223 Remington cartridge). In some embodiments, the depth of the notch 314 may be the same as the depth of the notch 502 shown in FIGS. 5A-5C, and the thickness may be increased along the outer side of the extractor. In order to provide improved strength and durability relative conventional designs, such as those shown in FIGS. 4A-4C and 5A-5C, while accommodating rounds with a cartridge casing having a greater diameter than the casing of a 5.56 NATO round and/or a .223 Remington round (e.g., a cartridge having a rim diameter greater than a 5.56 NATO or .223 Remington cartridge), the thickness of the extractor 300 at the notch 314 may be increased as described hereafter.

A thickness 324 of the extractor 300 as shown in FIGS. 10-13 in at least one location defined at the axial location of the notch 314 is greater than a thickness of the extractor of a modified, standard extractor for a given platform (e.g., AR-15) and a given cartridge size (e.g., 6 mm ARC or 6.5 mm Grendel). In some embodiments, the thickness of the extractor 300 in at least one location defined at the axial location of the notch 314 is greater than 0.019 inches. The at least one location, as show in FIGS. 12-13, may be disposed radially inward of one or more lugs of a barrel (e.g., barrel 12 in FIG. 2) or a barrel extension (e.g. extension 28 in FIG. 2) during cycling of the bolt 22 so that the location maintains clearance with the barrel and/or barrel extension and passes inward of the distal ends of the barrel lugs, whereas the lug-support tower 316 of the extractor 300 passes between barrel lugs during cycling of the bolt. As would be evident in light of the arcuate shape of the notch 314 in the circumferential direction, in some embodiments, the radially measured thickness of the extractor 300 between the notch 314 and the outer side 312 may vary circumferentially along the curve of the notch (e.g., the thickness isn't uniform). In some embodiments, the specified thickness may be the minimum thickness of the extractor at the notch, including locations with and without the support tower 316 of the extractor 300. Furthermore, as described hereafter, the outer side 312 and a height of the outer surface of the outer side 312 may vary along a length L of the extractor 300 and/or the outer surface may define or more recesses, intermediate surfaces, chamfers, bevels, etc. such that the thickness 324 defined above varies. As described herein, at least one location disposed radially inward of one or more lugs of a barrel or a barrel extension during cycling of the bolt 22 and defined at the axial location of the notch 314 is greater than 0.019 inches.

In some embodiments, the thickness 324 at the least one location may be greater than 0.019 inches. In some embodiments, the thickness 324 at the least one location may be greater than or equal to 0.043 inches. In some embodiments, the thickness 324 at the least one location may be less than or equal to 0.055 inches. In some embodiments, the thickness 324 at the least one location may be greater than 0.019 inches and less than or equal to 0.055 inches. In some embodiments, the thickness 324 at the least one location may be greater than or equal to 0.043 inches and less than or equal to 0.055 inches. In some embodiments, the thickness 324 at the least one location may be greater than 0.019 inches and less than or equal to 0.043 inches. In some embodiments, the thickness 324 at the least one location may be greater than or equal to approximately 0.043 inches. In some embodiments, the thickness 324 at the least one location may be less than or equal to approximately 0.055 inches. In some embodiments, the thickness 324 at the least one location may be greater than 0.019 inches and less than or equal to approximately 0.055 inches. In some embodiments, the thickness 324 at the least one location may be greater than or equal to approximately 0.043 inches and less than or equal to approximately 0.055 inches. In some embodiments, the thickness 324 at the least one location may be greater than 0.019 inches and less than or equal to approximately 0.043 inches. In some embodiments, the thickness 324 at the least one location may be between approximately 0.043 inches and approximately 0.055 inches. For example, the thickness 324 may be approximately 0.043 inches or greater than approximately 0.043 inches in instances in which the extractor is configured for use with a 6 mm ARC or 6.5 mm Grendel cartridge casing. In other embodiments, the thickness 324 at the at least one location may be approximately 0.055 inches, such as embodiments in which the extractor 300 is configured for use with a standard (e.g., non-modified) barrel extension.

As shown in FIGS. 6 and 8, the extractor 300 may further include a support tower 316 defined at the outer side 312 of the extractor 300 opposite the inner side 308 at an axial location of the extractor 300 between the pivot portion 310 and the first end 304. The support tower 316, as shown in FIG. 8, defines a width 318 in a lateral and circumferential direction perpendicular to the axis 305 that is less than a width W of the extractor 300. Said differently, the support tower 316 of the outer side 312 may span only a portion of the circumferential width of the extractor body such that there exist locations of the outer side 312 of the extractor that do not correspond with the support tower 316. Furthermore, the support tower 316 is positioned at a location other than the at least one location having the thickness 324 that is greater than 0.019 inches as described above. In other words, the thickness 324 of the extractor that is greater than 0.019 inches refers to a radially measured thickness of the extractor from the notch (e.g., at least one location defined at the axial location of the notch 314) to an outer surface of the outer side 312 that does not correspond to the support tower 316, such that at least one location other than the support tower has the specified thickness(es). In some embodiments, the thickness of the extractor 300 in all locations in a circumferential direction along a length of the notch 314, perpendicular to the axis 305, other than the location of the support tower 316, is greater than 0.019 inches.

In some further embodiments, the thickness 324 at the at least one location is greater than the first depth 326 but less than the second depth 328. Said differently, the radially measured thickness of the extractor 300 from the nozzle to the outer side 312 to a location that does not correspond to the support tower 316 is less than at least one radially measured depth of the notch 314 as measured from the inner side 308. Still further, in some embodiments, the thickness 324 may be at least approximately 20% of a greatest thickness 330 of the extractor 300 at the support tower 316. The greatest thickness 330 may refer to the largest radially measured thickness of the extractor 300 between the inner surface of the notch 309 and the outer side 312 axially aligned with the support tower 316 (e.g., a greatest thickness 330 of the body 302 at the first end 304 that includes the support tower 316). In this way, the thickness 324 of the notch 314 as radially measured from the notch 314 to the outer side 312 that does not include the support tower 316 may represent at least 20% of the thickness of the extractor 300 as radially measured from the notch 314 to the outer side 312 that includes the support tower 316. In some embodiments in which the thickness 324 is greater than or equal to approximately 0.043 inches, the thickness 324 may be at least approximately 46% of the greatest thickness 330 as defined above.

As shown in the side view of FIG. 10, the increase in the thickness of the extractor 300 as described above may be formed by increasing the height of the outer surface of the outer side 312 of the extractor 300 (e.g., a new extractor is manufactured having additional material on the outer side relative to the standard AR-15 extractor). As described above, the overall dimensions of the extractor 300 may be constrained by the dimensions associated with the firearm 10, the barrel 12, the bolt 22, and/or the like, such that increasing the overall dimensions of the extractor 300 to increase its relative strength is impossible or impracticable. For example, the depicted extractor must at least still fit between and/or radially inside of the lugs of the barrel or barrel extension of the firearm. As such, the extractor 300 of the present application may define the thickness 324 of the extractor 300 in at least one location defined at the axial location of the notch 314 that is greater than 0.019 inches by increasing the height of the outer surface of the outer side 312. This thickness increase may decrease a gap between the extractor and the radially distal end (e.g., the inwardly extending ends) of the barrel and/or barrel extension lugs without catching on the lugs during cycling as constrained by the clearance of the locking lugs 19 described above with reference to FIG. 2.

As shown in FIGS. 10 and 13, the outer surface of the outer side 313 may slope upwardly (e.g., radially outwardly) from a location 334 closer to the second end 306 to the at least one location at which the thickness 324 is defined. Said differently, a height 332 of an outer surface of the outer side 312 of the extractor 300 at the at least one location circumferentially or widthwise beside the support tower 316 (e.g., the location at which the thickness 324 is measured) relative to the axis 305 is greater than a height of the outer surface of the outer side 312 of the extractor 304 elsewhere along a length L of the extractor 300. Said differently, a height 332 of an outer surface of the outer side 312 of the extractor 300 at the at least one location (e.g., the location at which the thickness 324 is measured) relative to the axis 305 is greater than the height of a standard 5.56 NATO extractor 400 as shown in FIGS. 4A-4C. As described hereafter with reference to the method of FIG. 14, this height 332 may be created via an S-shaped machining path of the outer surface 312 in the axial direction on either side of the support tower 316 (e.g., less material from the outer surface 312 may be removed as a, for example, milling machine moves from the location 334 to the location at which thickness 324 is measured), whereas a standard extractor may be formed with a linear cut along the distal portion of the extractor. In each of the foregoing descriptions, "height" is interpreted in the relative sense as if a pivot axis of the pivot portion 310 and the axis 305 of the extractor were horizontal without regard to and without limiting the final installation orientation or location of the extractor.

In some of the depicted embodiments, the increased thickness of the extractor may extend over a certain length of the extractor, which length may at least overlap with the notch 314. In some embodiments, the length 337 of the heightened portion on the outer surface relative to a standard extractor may extend from the first end 304 to a position axially past the proximal edge 322 of the notch 314 (e.g., greater than a length measured from the first end 304 to the proximal edge 322 of the notch 314). In some embodiments, the length 340 of increased height on the outer surface relative to a standard extractor may extend from the first end 304 to a position axially past the proximal edge 322 of the notch 314 (e.g., greater than a length measured from the first end 304 to the proximal edge 322 of the notch 314). For example, with reference to FIG. 13, the portion having increased height on the outer surface relative to a standard extractor may extend over a length 340. In some embodiments, the length 340 may be at or approximately 0.235 inches. In some embodiments, the length 340 may be greater than or equal to 0.235 inches. In some embodiments, the length 340 may be less than or equal to 0.250 inches. In some embodiments, the length 340 may be greater than or equal to 0.125 inches and less than or equal to 0.250 inches. In some embodiments, as shown in FIG. 13, the increased height on the outer surface relative to a standard extractor may extend over a length of the extractor (e.g., length 340); however, the increased height may vary along the length 340. For example, the length 337 may refer to a portion of the length 340 that has a consistent height at least along a length of the extractor relative to a given plane on the longitudinal and radial axes (e.g., the support tower and/or the edges of the extractor may also be chamfered or otherwise transitioned to the thickened region) relative the outer surface. For example, the length 337 may extend from the first end to a position along the length 340 at which the height of the outer surface begins to decrease (e.g., following the S-shaped path described above). In some embodiments, the heightened portion having length 337 may terminate prior to the first end. In some embodiments, the length 337 may be greater than or equal to 0.125 inches.

This change in height of the outer surface may occur, for example, over a transition portion of the length 340 (e.g., length 339 in FIG. 13) between a position of the outer surface at the end of length 337 (e.g., measured relative the first end of the extractor) to the end of length 340 (e.g., a length that is the difference between length 340 and 337). The length 339, in some embodiments, may be greater than or equal to 0.110 inches. With continued reference to FIG. 13, a length 338 may refer to a length measured from the first end of the extractor body to a position of the outer surface at which change in height following the S-shaped path described above transitions from a convex radius (e.g., an outwardly curving surface) to an concave radius (e.g., an inwardly curving surface). Said differently, the length 338 may be measured from the first end of the extractor to a tangency point at which the convex radius transitions into a concave radius along the S-shaped path and said tangency point may be located axially past the notch 314 (e.g., axially past the proximal edge 322 of the notch 314) but proximate the notch 314. In some embodiments, the length 338 may be greater than or equal to 0.180 inches.

In any of the foregoing embodiments, the thickness 324 of the extractor may be measured from the inner surface 309 of the notch 314 to the outer side 312 of the extractor in the radial direction (e.g., along the axis C-C in FIG. 12), and the thickness may exclude thicknesses measured to the side walls of the extractor and/or to chamfered surfaces along such side walls. In some embodiments, the thickness 324 of the extractor may be equal to or greater than any of the aforementioned measurements (e.g., greater than 0.019 inches), such that the specified thickness at the at least one location is the minimum thickness of the extractor 300 at the axial location of the notch (e.g., within a plane perpendicular to the axis and intersecting the notch). In some embodiments, the extractor may be at least the thickness 324 or greater at locations from the proximal edge 322 of the notch 314 to the distal end 320 of the notch. The present disclosure contemplates that various surfaces, edges, etc. of the extractor may be chamfered, beveled, etc. and/or may include recesses, cuts, or the like so as to conform with applicable clearances associated with interaction as part of a bolt assembly. In any event, the thickness values described herein are independent of these chamfers, bevels, recesses, cuts, or the like such that these features do not impact the measurements described herein. Said differently, the thickness 324 may be measured from non-chamfered portions of inner and outer portions of the extractor 300.

Method of Manufacturing

With reference to FIG. 14, an example method of manufacturing 600 an extractor 300 of the present disclosure is illustrated. As shown, the method 600 may include providing a body at operation 602. As described above, the body of the extractor may be formed as a single, integral body (e.g., formed of a single piece of material) while in other embodiments, the body may be formed of a plurality of connected or assembled parts or elements. In any embodiment, providing the body at operation 602 may include providing a body formed of steel, stainless steel, steels alloys, aluminum, polymers, composites, or any material suitable for use in firearms. The body may define a first end, a second end opposite the first end, and an axis extended therethrough as described above with reference to FIGS. 6-13. The body may similarly define an inner side and an outer side opposite the inner side. In some embodiments, providing the body at operation 602 may include a turning operation (e.g., via a lathe or equivalent device) during which the profile of the body is defined. Furthermore, providing the body at operation 602 may include a boring operation during which material from the first end is removed to create the chamfer of the first end.

At operation 604, the method 600 may include removing material from the body to define a notch at the inner side of the extractor at an axial location between the second end and the first end (e.g., between the first end and a position at which the pivot portion will be located as described above), wherein, in operation, the notch is configured to engage a cartridge casing of a round having a casing greater than a cartridge casing of a 5.56 NATO and/or .223 Remington round). As described above, the extractor of the present disclosure may be configured for use with rounds having casing with a greater diameter than the cartridge casing of 5.56 NATO or .223 Remington rounds (e.g., a cartridge having a rim diameter greater than a 5.56 NATO or .223 Remington cartridge), such as a 6 mm ARC or a 6.5 mm Grendel cartridge casing. As such, the removing of material from the inner side of the extractor body to define the notch may cause the notch to be dimensioned (e.g., sized and shaped) to correspond to and engage a rim of a 6 mm ARC or 6.5 mm Grendel cartridge casing along the circumferential length (e.g., in a plane perpendicular to the axis 305) of the notch 314. Similar to operation 604, the material may be removed, for example, by milling, drilling, Electrical Discharge Machining (EDM), cutting, grinding, reaming, or by any other method known in the art. The EDM processes may include without limitation one or more of die-sinking or ram EDM, wire or wire cutting EDM, or other electrical discharge methods known in the art. In some embodiments, an endmill may be used to mill away material from at least the inner side of the extractor using a five axis milling machine. Operation 604 during which the notch is defined may further include one or more milling operations to remove material from the first end to define the recess (e.g., indentation, scallop, or the like) at the first end as described above.

In some embodiments, as shown in operation 606, the method 600 may include removing material from the outer surface to define a support tower extending from the outer surface of the extractor at an axial location of the extractor between second end and the first end at an opposing side of the notch (e.g., between the first end and a position at which the pivot portion will be located as described above). Prior to forming the support tower, the method 600 may include one or more milling operations that remove material from the body to substantially flatten the sides of the body (e.g., that extend between the interior surface and the exterior surface). As described above, the support tower defines a width in a circumferential direction perpendicular to the axis that is less than a width of the extractor. As shown in operation 608, the method may include removing material from an outer surface of outer side of the body opposite the inner surface on either side of the support tower 316 to define a thickness of the extractor in at least one location defined at the axial location of the notch disposed radially inward of one or more lugs of a barrel or a barrel extension during cycling of the bolt. In some embodiments, the thickness of the extractor at the notch is greater than 0.019 inches. As described above with reference to FIGS. 10 and 13, the outer surface of the outer side may slope upwardly (e.g., radially outwardly) from a location closer to the second end to the at least one location at which the thickness is defined. Said differently, a height of an outer surface of the outer side of the extractor at the at least one location (e.g., the location at which the thickness 324 is measured) relative to the axis is greater than a height of the outer surface of the outer side of the extractor elsewhere along a length of the extractor. Following defining the support tower, operation 608 may further include milling the sides of the support tower square (e.g., substantially perpendicular with respect to) the sides of the body, milling the interior surface of the body substantially flat, and/or milling the sides of the body proximate the first end to chamfer one or more surfaces proximate the first end.

In order to complete the sloped or S-shaped profile, an endmill may be used to mill away material from at least the outer side of the extractor using a five axis milling machine and may follow a sloped or S-shaped profile. In some embodiments, the milling machine may translate its bit from the first end towards the second end at a first height and subsequently transition to a second, lower height after passing the axial location of the notch. In some embodiments, the milling machine may translate its bit from the second end or an intermediate position proximal of the first end towards the first end at a second height and subsequently transition to a first, higher height prior to reaching the axial location of the notch. In some embodiments, the notch represents the thinnest portion of the extractor along at least some of its width. Although described with reference to a milling operation, the present disclosure contemplates that operations 306, 308 may similarly be completed via drilling, Electrical Discharge Machining (EDM), cutting, grinding, reaming, or by any other method known in the art. Furthermore, although operations 304-310 are described as occurring sequentially, the present disclosure contemplates that one or more of these operations may occur simultaneously and/or one or more operations may occur in a different order (e.g., the support tower may be formed prior to the notch).

Thereafter, at operation 610, the method 600 may include providing a pivot portion either by shaping the pivot portion from the same material as the body or by attaching a pivot portion. As described above, the inner side of the extractor may define a pivot portion between the first end and the second end (e.g., between the notch and the second end). The pivot portion may be manufactured by removing material from the inner side of the extractor between the first end and the second end and/or drilling one more through holes for use in pivotally attaching (e.g., receiving an associated extractor pin 301 in FIG. 3). The material may be removed, for example, by milling, drilling, Electrical Discharge Machining (EDM), cutting, grinding, reaming, or by any other method known in the art. The EDM processes may include without limitation one or more of die-sinking or ram EDM, wire or wire cutting EDM, or other electrical discharge methods known in the art. In some embodiments, an endmill may be used to mill away material from at least the inner side of the extractor using a five axis milling machine.

In some embodiments, the extractors 300 discussed herein may be used as part of a new firearm or as replacement parts for an existing firearm. For example, the extractor 300 may be configured to fit within a standard platform (e.g., an AR-15® platform, M4 platform, or the like) without otherwise modifying the platform, and the extractor 300 may be retrofit to a firearm as a replacement for the extractor 500 of FIGS. 5A-5B without otherwise modifying the firearm.

The embodiments described herein may also be scalable to accommodate at least the aforementioned applications. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A firearm extractor having a maximum width, the firearm extractor comprising:

a first end;

a second end opposite the first end, the first end and the second end defining an axis extending therebetween;

a pivot portion defined between the first end and the second end, the pivot portion disposed at an inner side of the extractor, wherein the pivot portion is configured to engage a bolt;

a support tower defined at an outer side of the extractor and positioned forward of the pivot portion, the support tower having a width that is less than the maximum width of the extractor; and a notch defined at the inner side of the extractor at an axial location between the pivot portion and the first end, wherein, in operation, the notch is configured to engage a cartridge casing having a diameter greater than a casing of a 5.56 NATO cartridge, wherein a thickness of the extractor in at least one location defined at the axial location of the notch is greater than 0.019 inches, wherein the at least one location is configured to be disposed radially inward of one or more lugs of a barrel or a barrel extension during cycling of the bolt, wherein the notch has a curved configuration defined at least in part by an inner surface that is curved in a circumferential direction perpendicular to the axis, and wherein outer surfaces of the outer side of the extractor that are adjacent to and flank with the support tower define sloped regions that slope upwardly toward the first end from a location that is forward of an aft-most end of the support tower.

2. The extractor according to claim 1, wherein the thickness at the at least one location is greater than or equal to approximately 0.043 inches and less than or equal to approximately 0.055 inches.

3. The extractor according to claim 2, wherein the thickness at the at least one location is approximately 0.043 inches.

4. The extractor according to claim 2, wherein the thickness at the at least one location is approximately 0.055 inches.

5. The extractor according to claim 1, wherein the thickness at the at least one location is less than or equal to approximately 0.055 inches.

6. The extractor according to claim 1, wherein the thickness at the at least one location is greater than or equal to approximately 0.043 inches.

7. The extractor according to claim 1, further comprising a support tower defined at an outer side of the extractor opposite the inner side at an axial location of the extractor between the pivot portion and the first end, wherein the support tower defines a width in a circumferential direction perpendicular to the axis that is less than a width of the extractor, and wherein the support tower is positioned at a location other than the at least one location having the thickness that is greater than 0.019 inches.

8. The extractor according to claim 7, wherein the thickness of the extractor in all locations in a circumferential direction along a length of the notch, perpendicular to the axis, other than the location of the support tower is greater than 0.019 inches.

9. The extractor according to claim 7, wherein a height of an outer surface of the outer side of the extractor at the at least one location relative to the axis is greater than a height of the outer surface of the outer side of the extractor elsewhere along a length of the extractor.

10. The extractor according to claim 7, wherein a height of an outer surface of the outer side of the extractor at the at least one location relative to the axis is greater than the height of a 5.56 extractor for an AR pattern firearm.

11. The extractor according to claim 1, further comprising a recess defined by the first end.

12. The extractor according to claim 1, wherein a length of the notch defined between a proximal end and a distal end, the distal end being located in between the proximal end of the notch and the first end of the extractor, and wherein a first depth of the notch defined in the radial direction between an inner surface of the notch and a proximal edge at the proximal end is greater than a second depth defined in the radial direction between the inner surface and a distal edge at the distal end of the notch.

13. The extractor according to claim 1, wherein the extractor defines a constant width along an entire length of the extractor.

14. The extractor according to claim 1, wherein the thickness from an outer side of the extractor to the inner surface of the notch measured perpendicular to the inner surface of the notch is greater than 0.0019 at each location along the inner surface of the notch.

15. The extractor according to claim 1, wherein the sloped regions slope upwardly to a location that is axially aligned with the notch.

16. The extractor according to claim 1, wherein the thickness at the at least one location is a minimum thickness of the extractor at the axial location of the notch.

17. A bolt assembly for a firearm comprising:

a bolt configured to engage one or more lugs of a barrel or a barrel extension during cycling of the bolt, the bolt defining a groove; and the extractor according to claim 1 received by the groove of the bolt and pivotally attached with the bolt via the pivot portion of the extractor.

18. A firearm comprising:

barrel assembly comprising:

a barrel or a barrel extension defining one or more locking lugs, the barrel comprising an inner surface defining a bore configured to guide a projectile as the projectile is propelled through the bore by pressurized gas, the barrel defining:

a muzzle end; and a chamber end opposite the muzzle end, wherein the inner surface defines a chamber at the chamber end, wherein the chamber is configured to receive a cartridge and to support at least a portion of a cartridge casing during firing;

a bolt defining:

one or more bolt lugs configured to engage the one or more locking lugs of the barrel extension; and a groove; and the extractor according to claim 1 received by the groove of the bolt and pivotally attached with the bolt via the pivot portion of the extractor.

19. The firearm of claim 18, wherein the firearm is an AR-15 platform weapon.

20. A firearm extractor having a maximum width, the firearm extractor comprising:

a first end;

a second end opposite the first end, the first end and the second end defining an axis extending therebetween;

a pivot portion defined between the first end and the second end, the pivot portion disposed at an inner side of the extractor, wherein the pivot portion is configured to engage a bolt;

a support tower defined at an outer side of the extractor and positioned forward of the pivot portion, the support tower having a width that is less than the maximum width of the extractor, the support tower having a planar top that extends axially; and a notch defined at the inner side of the extractor at an axial location between the pivot portion and the first end, wherein, in operation, the notch is configured to engage a cartridge casing having a diameter greater than a casing of a 5.56 NATO cartridge, wherein a thickness of the extractor in at least one location defined at the axial location of the notch is greater than 0.019 inches, wherein the at least one location is configured to be disposed radially inward of one or more lugs of a barrel or a barrel extension during cycling of the bolt, wherein the notch has a curved configuration defined at least in part by an inner surface that is curved in a circumferential direction perpendicular to the axis, and wherein an outer surfaces of the outer side of the extractor that are adjacent to and flank with the support tower define sloped regions that slope upwardly toward the first end to a location that is forward of an aft end of with the planar top of the support tower.

21. A method of manufacturing at least a portion of a firearm extractor, the method comprising:

providing a body defining:

a first end;

a second end opposite the first end, the first end and the second end defining an axis extending therebetween; and a maximum width;

providing a pivot portion positioned between the first end and the second end, the pivot portion disposed at an inner side of the body of the extractor, wherein the pivot portion is configured to engage a bolt;

providing a support tower defined at an outer side of the extractor and positioned forward of the pivot portion, the support tower having a width that is less than the maximum width of the extractor; and removing material from the body to define a notch at the inner side of the extractor at an axial location between the pivot portion and the first end, wherein, in operation, the notch is configured to engage a cartridge casing having a diameter greater than a casing of a 5.56 NATO cartridge, wherein the notch has a curved configuration defined at least in part by an inner surface that is curved in a circumferential direction perpendicular to the axis; and removing material from an outer surface of the body opposite the inner surface to define a thickness of the extractor in at least one location defined at the axial location of the notch disposed radially inward of one or more lugs of a barrel or a barrel extension during cycling of the bolt, wherein the thickness is greater than 0.019 inches, wherein the removing of material from the outer surface of the body follows a path that defines a sloped region that slopes upwardly toward the first end from a location that is forward of an aft-most end of the support tower.

22. The method according to claim 21, wherein removing material from the outer surface further defines a support tower extending from the outer surface of the extractor at an axial location of the extractor between the pivot portion and the first end, wherein the support tower defines a width in a circumferential direction perpendicular to the axis that is less than a width of the extractor, and wherein the support tower is positioned at a location other than the at least one location.

23. The method according to claim 21, further comprising removing material from the first end to define a recess in the first end.

* * * * *